US010074271B1

(12) United States Patent
Gubarev et al.

(10) Patent No.: US 10,074,271 B1
(45) Date of Patent: Sep. 11, 2018

(54) METHODS AND SYSTEMS FOR GENERATING A TRAFFIC PREDICTION

(71) Applicant: YANDEX EUROPE AG, Lucerne (CH)

(72) Inventors: Ilya Aleksandrovich Gubarev, Moscow (RU); Ivan Sergeyevich Kargapoltsev, Gagarin (RU); Vitalii Sergeevich Kochurov, Moscow (RU)

(73) Assignee: YANDEX EUROPE AG, Lucerne (CH)

( * ) Notice: Subject to any disclaimer, the term of this patent is extended or adjusted under 35 U.S.C. 154(b) by 0 days.

(21) Appl. No.: 15/829,456

(22) Filed: Dec. 1, 2017

(30) Foreign Application Priority Data

Jun. 2, 2017 (RU) ..... 2017119307

(51) Int. Cl.
*G08G 1/01* (2006.01)

(52) U.S. Cl.
CPC ..... *G08G 1/012* (2013.01); *G08G 1/0125* (2013.01)

(58) Field of Classification Search
CPC ..... G08G 1/012; G08G 1/0125
USPC ..... 340/933
See application file for complete search history.

(56) References Cited

U.S. PATENT DOCUMENTS 8,537,145 B2 9/2013 Cuende
9,161,084 B1 * 10/2015 Sharma ..... G06K 9/00778
9,390,621 B2 * 7/2016 Cuende Alonso ..... G01C 21/36
2005/0206534 A1 * 9/2005 Yamane ..... G08G 1/0104 340/994
2007/0208495 A1 * 9/2007 Chapman ..... G08G 1/0104 701/117
2008/0004953 A1 1/2008 Ma et al.
2013/0287261 A1 10/2013 Lee et al.
2013/0339140 A1 12/2013 Pokorny et al.
2014/0270524 A1 * 9/2014 Diamond ..... G06K 9/6298 382/170

(Continued)

OTHER PUBLICATIONS

Liebig et al., "Pedestrian quantity estimation with trajectory patterns", Machine Learning and Knowledge Discovery in Databases, Springer, 2012, vol. LNCS 7524, pp. 629-643.

(Continued)

*Primary Examiner* — Kerri McNally
(74) *Attorney, Agent, or Firm* — BCF LLP

(57) ABSTRACT

A method and server for generating a traffic prediction for a target zone is provided. The traffic is caused by feedback and non-feedback vehicles in the target zone. Feedback vehicles are associated with devices that provide signals. The method comprises: tracking signals of devices entering a sample zone which comprise coordinates of devices; processing the signals tracked for the devices, the processing comprises: determining an actual number of feedback vehicles in the sample zone; computing a fill rate parameter which is indicative of an estimated total number of vehicles in the sample zone; and determining a feedback ratio which is indicative of an estimated proportion of feedback and non-feedback vehicles in the sample zone; determining an actual number of feedback vehicles entering the target zone; and generating the traffic prediction for the target zone which is indicative of an estimated number of non-feedback vehicles causing traffic in the target zone.

20 Claims, 7 Drawing Sheets

(56) References Cited

U.S. PATENT DOCUMENTS

| | | | | |
|---|---|---|---|---|
| 2014/0278044 | A1* | 9/2014 | Jacobs | G06F 17/00 701/300 |
| 2015/0149285 | A1 | 5/2015 | Schroeter | |
| 2015/0363828 | A1 | 12/2015 | Mantalovos | |
| 2017/0309171 | A1* | 10/2017 | Zhao | G01S 19/13 |

OTHER PUBLICATIONS

Wally et al., "Presence Sensing Billboards", Proceedings of the 2nd International Workshop on Pervasive Advertising (in Conjunction with Informatik 2009), Lübeck, Germany, Sep. 2009.

* cited by examiner

METHODS AND SYSTEMS FOR GENERATING A TRAFFIC PREDICTION

CROSS-REFERENCE

The present application claims priority to Russian Patent Application No. 2017119307, filed on Jun. 2, 2017, entitled "Methods and Systems for Generating a Traffic Prediction," the entirety of which is incorporated herein by reference.

FIELD OF TECHNOLOGY

The present technology relates to traffic predictions and, more specifically, to methods and systems for generating a traffic prediction for a target zone where traffic is caused by vehicles.

BACKGROUND

Conventional traffic prediction methods and systems generally provide an estimation of a general traffic flow through predetermined areas. For example, estimation of traffic flow in proximity of Visual Points of Interest (VPOIs) is a good way to estimate the audience that can potentially view and recognize VPOIs such as: architectural buildings, road traffic signalization, electronic billboards, etc. These predetermined areas from which the audience may be visually exposed to VPOIs can be located near roadways, airports, hotels, shopping centers, etc.

These known traffic estimation methods usually involve vehicle detection solutions and systems that are configured to count a number of vehicles that travel through the predetermined areas. Such vehicle detection solutions may use cameras or human assessors to estimate traffic for the given area.

Vehicle detection solutions which implement cameras may be configured to identify some vehicles that are recognizable via video footage generated by a camera that is installed near and is angled towards the area for recording traffic travelling through it. Such vehicle detection solutions are sensitive and their performance varies with respect to weather, illumination, period of day, degree of traffic as well as quality, location and angle of the camera.

Vehicle detection solutions which implement human assessors are generally directed to the evaluation of a number of vehicles travelling through the area where human assessors are located and are tasked with counting the number of vehicles that they see travelling through the area. Such vehicle detection solutions can be expensive and, for large scale traffic evaluation implementations, may be very difficult to coordinate due to a large number of areas that require traffic evaluation and/or due to large number of vehicles during rush hours, which renders vehicle counting by human assessors nearly impossible. Moreover, potential audience of a VPOI may be difficult to estimate via vehicle detection solutions that rely on human assessors since there might be a significant discrepancy between the area visible to the human assessor for which he is tasked to count the number of vehicles passing through the area and the visual exposure zone of the VPOI from which the VPOI is potentially visible.

Other methods known in the art for estimating traffic in predetermined areas rely on navigational devices associated with vehicles and their positional feedback capabilities. Such traffic estimation methods allow determining a number of vehicles that traveled through a given area based on the positional feedback capabilities of the navigational devices that are within those vehicles. However, such traffic estimation methods may be, in some cases, unreliable or prone to significant estimation errors since they take into account solely the traffic caused by vehicles which are associated with navigational devices.

For the foregoing reasons, there is a need for new methods and systems for generating traffic predictions.

SUMMARY

Embodiments of the present technology have been developed based on developers' appreciation that while the determination of a number of feedback vehicles (i.e., associated with navigational devices) that traveled through a given area is possible, the estimation of non-feedback vehicles (i.e., not associated with navigational devices) cannot be achieved by conventional methods that employ positional feedback capabilities of the navigational devices. Embodiments of the present technology have been developed based on developers' appreciation of at least one technical problem associated with the prior art solutions. Therefore, developers have devised methods and systems for generating traffic predictions for a given area, where the traffic in the area is caused by both feedback vehicles and non-feedback vehicles.

In a first aspect of the present technology, there is provided a method of generating a traffic prediction for a target zone. The target zone is defined by first boundary coordinates having been geometrically predetermined. Traffic in the target zone is caused by a plurality of vehicles located in the target zone at a given moment in time. The plurality of vehicles comprises feedback vehicles and non-feedback vehicles. Each of the feedback vehicles is associated with a respective navigational device. The navigational devices are communicatively coupled to a server by a communication network and configured to provide respective feedback signals to the server. The method is executable on the server.

The method comprises tracking, by the server, a feedback signal of each one of a first plurality of navigational devices entering a traffic sample zone. The traffic sample zone is defined by second boundary coordinates having been geometrically predetermined. The traffic sample zone is associated with traffic characteristics. The traffic characteristics are indicative of a maximum possible number of vehicles that can be located in the traffic sample zone at once. Each feedback signal comprises positional coordinates of a respective one of the first plurality of navigational devices.

The method also comprises tracking, processing, by the server, the feedback signals tracked for the first plurality of navigational devices.

The processing comprises determining, by the server, an actual number of feedback vehicles located in the traffic sample zone at a first moment in time by comparing the positional coordinates of each one of the first plurality of navigational devices against the second boundary coordinates at the first moment in time.

The processing also comprises computing, by the server, a fill rate parameter of the traffic sample zone at the first moment in time based on (i) the positional coordinates of at least one navigational device within the second boundary coordinates, (ii) the second boundary coordinates and (iii) the traffic characteristics. The fill rate parameter is indicative of an estimated total number of vehicles located in the traffic sample zone at the first moment in time.

The processing also comprises determining, by the server, a feedback ratio associated with the traffic sample zone and which is a ratio between (i) the estimated total number of vehicles located in the traffic sample zone and (ii) the actual number of feedback vehicles located in the traffic sample zone. The feedback ratio is indicative of an estimated proportion of feedback vehicles and of non-feedback vehicles located in the traffic sample zone.

The method also comprises determining, by the server, an actual number of feedback vehicles located in the target zone based on a feedback signal of each one of a second plurality of navigational devices entering the target zone.

The processing also comprises generating, by the server, the traffic prediction for the target zone based on (i) the actual number of feedback vehicles in the target zone and (ii) the feedback ratio. The traffic predication is indicative of an estimated number of non-feedback vehicles within the plurality of vehicles causing traffic in the target zone.

In some embodiments of the method, the method further comprises providing, by the server, to the navigational devices information associated with the first and second boundary coordinates.

In some embodiments of the method, the traffic characteristics comprise a first type of traffic characteristic and a second type of traffic characteristic.

In some embodiments of the method, the first type of traffic characteristic is a vehicle-specific traffic characteristic and the second type of traffic characteristic is a zone-specific traffic characteristic.

In some embodiments of the method, the vehicle-specific traffic characteristic comprises an average size of vehicles.

In some embodiments of the method, the zone-specific traffic characteristic comprises:

an area overlapped by the traffic sample zone;

a number of traffic lanes overlapped by the traffic sample zone;

a traffic direction in the traffic sample zone; and an average vehicle-to-vehicle distance in the traffic sample zone.

In some embodiments of the method, the computing the fill rate parameter comprises identifying, by the server, rearmost positional coordinates amongst the positional coordinates of the at least one navigational device within the second boundary coordinates. The rearmost positional coordinates are the positional coordinates of a rearmost navigational device amongst the at least one navigational device within the second boundary coordinates according to the traffic direction in the traffic sample zone.

In some embodiments of the method, the identifying rearmost positional coordinates amongst the positional coordinates of the at least one navigational device within the second boundary coordinates comprises determining, by the server, at least one of (i) traffic-entering boundary coordinates within the second boundary coordinates and (ii) traffic-exiting boundary coordinates within the second boundary coordinates based on the traffic direction in the traffic sample zone. The identifying rearmost positional coordinates also comprises comparing, by the server, each of the positional coordinates of the at least one navigational device within the second boundary coordinates against the at least one of (i) the traffic-entering boundary coordinates and (ii) the traffic-exiting boundary coordinates. The identifying rearmost positional coordinates also comprises selecting, by the server, a given one of the positional coordinates of the at least one navigational device as the rearmost positional coordinates such that the given one of the positional coordinates is at least one of (i) closest positional coordinates amongst the positional coordinates of the at least one navigational device to the traffic-entering boundary coordinates and (ii) farthest positional coordinates amongst the positional coordinates of the at least one navigational device from the traffic-exiting boundary coordinates.

In some embodiments of the method, the computing the fill rate parameter based on the rearmost positional coordinates amongst the positional coordinates of the at least one navigational device within the second boundary coordinates comprises computing, by the server, the fill rate parameter such that to maximize the estimated total number of vehicles located in the traffic sample zone in comparison with any other fill rate parameter if computed based on any other positional coordinates amongst the positional coordinates of the at least one navigational device within the second boundary coordinates.

In some embodiments of the method, the computing the fill rate parameter comprises determining, by the server, an estimated number of vehicles located in a same traffic lane as the rearmost navigational device and located in the traffic sample zone based on (i) the rearmost positional coordinates, (ii) the average size of vehicles, and (iii) the average vehicle-to-vehicle distance in the traffic sample zone. The computing the fill rate parameter also comprises multiplying, by the server, the estimated number of vehicles located in the same traffic lane as the rearmost navigational device and located in the traffic sample zone by the number of traffic lanes overlapped by the traffic sample zone.

In some embodiments of the method, the determining the actual number of feedback vehicles located in the target zone and the generating the traffic prediction for the target zone are executable at a second moment in time that is later in time than the first moment in time.

In some embodiments of the method, the feedback ratio is updated by the server on a periodic basis.

In some embodiments of the method, the target zone at least partially overlaps the traffic sample zone.

In some embodiments of the method, the first plurality of navigational devices comprises at least one navigational device amongst the second plurality of navigational devices.

In a second aspect of the present technology, there is provided a method of determining an exposure parameter for a visual point of interest (VPOI). The VPOI is visible to a plurality of observers located in an exposure zone at a given moment in time. The exposure zone is defined by first boundary coordinates having been geometrically predetermined based on at least a location of the VPOI. The plurality of observers comprises feedback observers and non-feedback observers. Each of the feedback observers is associated with a respective navigational device. The navigational devices are communicatively coupled to a server by a communication network and configured to provide respective feedback signals to the server. The method is executable on the server.

The method comprises tracking, by the server, a feedback signal of each one of a first plurality of navigational devices entering a traffic sample zone. The traffic sample zone is defined by second boundary coordinates having been geometrically predetermined. The traffic sample zone is associated with traffic characteristics. The traffic characteristics are indicative of a maximum possible number of observers that can be located in the traffic sample zone at once. Each feedback signal comprises positional coordinates of a respective one of the first plurality of navigational devices.

The method also comprises processing, by the server, the feedback signals tracked for the first plurality of navigational devices. The processing comprises determining, by the server, an actual number of feedback observers located in the traffic sample zone at a first moment in time by comparing the positional coordinates of each one of the first plurality of navigational devices against the second boundary coordinates at the first moment in time.

The processing also comprises computing, by the server, a fill rate parameter of the traffic sample zone at the first moment in time based on (i) the positional coordinates of at least one navigational device within the second boundary coordinates, (ii) the second boundary coordinates and (iii) the traffic characteristics. The fill rate parameter is indicative of an estimated total number of observers located in the traffic sample zone at the first moment in time.

The processing also comprises determining, by the server, a feedback ratio associated with the traffic sample zone and which is a ratio between (i) the estimated total number of observers located in the traffic sample zone and (ii) the actual number of feedback observers located in the traffic sample zone. The feedback ratio is indicative of an estimated proportion of feedback observers and of non-feedback observers located in the traffic sample zone.

The method also comprises determining, by the server, an actual number of feedback observers located in the exposure zone based on a feedback signal of each one of a second plurality of navigational devices entering the exposure zone The method also comprises determining, by the server, the exposure parameter for the VPOI based on (i) the actual number of feedback observers in the exposure zone and (ii) the feedback ratio. The exposure parameter is indicative of an estimated number of observers that possibly viewed the VPOI.

In some embodiments of the method, the method further comprises providing, by the server, to the navigational devices information associated with the first and second boundary coordinates.

In some embodiments of the method, the traffic characteristics comprise a first type of traffic characteristic and a second type of traffic characteristic.

In some embodiments of the method, the first type of traffic characteristic is a vehicle-specific traffic characteristic and the second type of traffic characteristic is a zone-specific traffic characteristic.

It is contemplated that in some embodiments of the method, each feedback observer is associated with a respective feedback vehicle and a respective navigational device and that each non-feedback observer is associated with a respective non-feedback vehicle.

In some embodiments of the method, the vehicle-specific traffic characteristic comprises an average size of vehicles.

In some embodiments of the method, the zone-specific traffic characteristic comprises:

an area overlapped by the traffic sample zone;

a number of traffic lanes overlapped by the traffic sample zone;

a traffic direction in the traffic sample zone; and an average vehicle-to-vehicle distance in the traffic sample zone.

In some embodiments of the method, the computing the fill rate parameter comprises identifying, by the server, rearmost positional coordinates amongst the positional coordinates of the at least one navigational device within the second boundary coordinates. The rearmost positional coordinates are the positional coordinates of a rearmost navigational device amongst the at least one navigational device within the second boundary coordinates according to the traffic direction in the traffic sample zone.

In some embodiments of the method, the identifying rearmost positional coordinates amongst the positional coordinates of the at least one navigational device within the second boundary coordinates comprises determining, by the server, at least one of (i) traffic-entering boundary coordinates within the second boundary coordinates and (ii) traffic-exiting boundary coordinates within the second boundary coordinates based on the traffic direction in the traffic sample zone. The identifying rearmost positional coordinates also comprises comparing, by the server, each of the positional coordinates of the at least one navigational device within the second boundary coordinates against the at least one of (i) the traffic-entering boundary coordinates and (ii) the traffic-exiting boundary coordinates. The identifying rearmost positional coordinates also comprises selecting, by the server, a given one of the positional coordinates of the at least one navigational device as the rearmost positional coordinates such that the given one of the positional coordinates is at least one of (i) closest positional coordinates amongst the positional coordinates of the at least one navigational device to the traffic-entering boundary coordinates and (ii) farthest positional coordinates amongst the positional coordinates of the at least one navigational device from the traffic-exiting boundary coordinates.

In some embodiments of the method, the computing the fill rate parameter based on the rearmost positional coordinates amongst the positional coordinates of the at least one navigational device within the second boundary coordinates comprises computing, by the server, the fill rate parameter such that to maximize the estimated total number of observers located in the traffic sample zone in comparison with any other fill rate parameter if computed based on any other positional coordinates amongst the positional coordinates of the at least one navigational device within the second boundary coordinates.

It is contemplated that the estimated total number of observers located in the traffic sample zone may be equal to the estimated total number of vehicles located in the traffic sample zone since each observer is associated with a respective vehicle.

In some embodiments of the method, the computing the fill rate parameter comprises determining, by the server, an estimated number of observer located in a same traffic lane as the rearmost navigational device and located in the traffic sample zone based on (i) the rearmost positional coordinates, (ii) the average size of vehicles, and (iii) the average vehicle-to-vehicle distance in the traffic sample zone. The computing the fill rate parameter also comprises multiplying, by the server, the estimated number of observer located in the same traffic lane as the rearmost navigational device and located in the traffic sample zone by the number of traffic lanes overlapped by the traffic sample zone.

In some embodiments of the method, the determining the actual number of feedback observers located in the exposure zone and the determining the exposure parameter for the VPOI are executable at a second moment in time that is later in time than the first moment in time.

In some embodiments of the method, the feedback ratio is updated by the server on a periodic basis.

In some embodiments of the method, the exposure zone at least partially overlaps the traffic sample zone.

In some embodiments of the method, the first plurality of navigational devices comprises at least one navigational device amongst the second plurality of navigational devices.

In some embodiments of the method, the boundary coordinates of the exposure zone are dynamically updated based on camera data for the second moment in time.

In a third aspect of the present technology, there is provided a server for generating a traffic prediction for a target zone. The target zone is defined by first boundary coordinates having been geometrically predetermined. Traffic in the target zone is caused by a plurality of vehicles located in the target zone at a given moment in time. The plurality of vehicles comprising feedback vehicles and non-feedback vehicles. Each of the feedback vehicles is associated with a respective navigational device. The navigational devices are communicatively coupled to the server by a communication network and configured to provide respective feedback signals to the server.

The server is configured to track a feedback signal of each one of a first plurality of navigational devices entering a traffic sample zone. The traffic sample zone is defined by second boundary coordinates having been geometrically predetermined. The traffic sample zone is associated with traffic characteristics. The traffic characteristics are indicative of a maximum possible number of vehicles that can be located in the traffic sample zone at once. Each feedback signal comprises positional coordinates of a respective one of the first plurality of navigational devices.

The server is also configured to process the feedback signals tracked for the first plurality of navigational devices. The server configured to process the feedback signals is further configured to determine an actual number of feedback vehicles located in the traffic sample zone at a first moment in time by comparing the positional coordinates of each one of the first plurality of navigational devices against the second boundary coordinates at the first moment in time.

The server configured to process the feedback signals is further configured to compute a fill rate parameter of the traffic sample zone at the first moment in time based on (i) the positional coordinates of at least one navigational device within the second boundary coordinates, (ii) the second boundary coordinates and (iii) the traffic characteristics. The fill rate parameter is indicative of an estimated total number of vehicles located in the traffic sample zone at the first moment in time.

The server configured to process the feedback signals is further configured to determine a feedback ratio associated with the traffic sample zone and which is a ratio between (i) the estimated total number of vehicles located in the traffic sample zone and (ii) the actual number of feedback vehicles located in the traffic sample zone. The feedback ratio is indicative of an estimated proportion of feedback vehicles and of non-feedback vehicles located in the traffic sample zone.

The server is also configured to determine an actual number of feedback vehicles located in the target zone based on a feedback signal of each one of a second plurality of navigational devices entering the target zone.

The server is also configured to generate the traffic prediction for the target zone based on (i) the actual number of feedback vehicles in the target zone and (ii) the feedback ratio. The traffic predication is indicative of an estimated number of non-feedback vehicles within the plurality of vehicles causing traffic in the target zone.

In some embodiments of the server, the server is further configured to provide to the navigational devices information associated with the first and second boundary coordinates.

In some embodiments of the server, the traffic characteristics comprise a first type of traffic characteristic and a second type of traffic characteristic.

In some embodiments of the server, the first type of traffic characteristic is a vehicle-specific traffic characteristic and the second type of traffic characteristic is a zone-specific traffic characteristic.

In some embodiments of the server, the vehicle-specific traffic characteristic comprises an average size of vehicles.

In some embodiments of the server, the zone-specific traffic characteristic comprises:

an area overlapped by the traffic sample zone;

a number of traffic lanes overlapped by the traffic sample zone;

a traffic direction in the traffic sample zone; and an average vehicle-to-vehicle distance in the traffic sample zone.

In some embodiments of the server, the server configured to compute the fill rate parameter is further configured to identify rearmost positional coordinates amongst the positional coordinates of the at least one navigational device within the second boundary coordinates. The rearmost positional coordinates are the positional coordinates of a rearmost navigational device amongst the at least one navigational device within the second boundary coordinates according to the traffic direction in the traffic sample zone.

In some embodiments of the server, the server configured to identify the rearmost positional coordinates amongst the positional coordinates of the at least one navigational device within the second boundary coordinates is further configured to determine at least one of (i) traffic-entering boundary coordinates within the second boundary coordinates and (ii) traffic-exiting boundary coordinates within the second boundary coordinates based on the traffic direction in the traffic sample zone. The server configured to identify the rearmost positional coordinates is also further configured to compare each of the positional coordinates of the at least one navigational device within the second boundary coordinates against the at least one of (i) the traffic-entering boundary coordinates and (ii) the traffic-exiting boundary coordinates. The server configured to identify the rearmost positional coordinates is also further configured to select a given one of the positional coordinates of the at least one navigational device as the rearmost positional coordinates such that the given one of the positional coordinates is at least one of (i) closest positional coordinates amongst the positional coordinates of the at least one navigational device to the traffic-entering boundary coordinates and (ii) farthest positional coordinates amongst the positional coordinates of the at least one navigational device from the traffic-exiting boundary coordinates.

In some embodiments of the server, the server configured to compute the fill rate parameter based on the rearmost positional coordinates amongst the positional coordinates of the at least one navigational device within the second boundary coordinates is further configured to compute the fill rate parameter such that to maximize the estimated total number of vehicles located in the traffic sample zone in comparison with any other fill rate parameter if computed based on any other positional coordinates amongst the positional coordinates of the at least one navigational device within the second boundary coordinates.

In some embodiments of the server, the server configured to compute the fill rate parameter is further configured to determine an estimated number of vehicles located in a same traffic lane as the rearmost navigational device and located in the traffic sample zone based on (i) the rearmost positional coordinates, (ii) the average size of vehicles, and (iii) the average vehicle-to-vehicle distance in the traffic sample zone. The server configured to compute the fill rate parameter is further configured to multiply the estimated number of vehicles located in the same traffic lane as the rearmost navigational device and located in the traffic sample zone by the number of traffic lanes overlapped by the traffic sample zone.

In some embodiments of the server, the server configured to determine the actual number of feedback vehicles located in the target zone and to generate the traffic prediction for the target zone is further configured to determine the actual number of feedback vehicles located in the target zone and to generate the traffic prediction for the target zone at a second moment in time that is later in time than the first moment in time.

In some embodiments of the server, the feedback ratio is updated by the server on a periodic basis.

In some embodiments of the server, the target zone at least partially overlaps the traffic sample zone.

In some embodiments of the server, the first plurality of navigational devices comprises at least one navigational device amongst the second plurality of navigational devices.

In at least one embodiment of the present technology, the server is configured to execute an improved method of generating a traffic prediction. It should be appreciated that generating a traffic prediction that takes into account solely the feedback vehicles may be prone to significant estimation errors since non-feedback vehicles may considerably affect the traffic on a given route. The improved method may generate traffic predictions that take into account both the feedback vehicles and the non-feedback vehicles. Although the server is unaware of the vehicle-navigational information about the non-feedback vehicles, the server is configured to generate the traffic prediction where traffic is generated by feedback and non-feedback vehicles.

In a fourth aspect of the present technology, there is provided a server for determining an exposure parameter for a visual point of interest (VPOI). The VPOI is visible to a plurality of observers located in an exposure zone at a given moment in time. The exposure zone is defined by first boundary coordinates having been geometrically predetermined based on at least a location of the VPOI. The plurality of observers comprises feedback observers and non-feedback observers. Each of the feedback observers is associated with a respective navigational device. The navigational devices are communicatively coupled to the server by a communication network and configured to provide respective feedback signals to the server.

The server is configured to track a feedback signal of each one of a first plurality of navigational devices entering a traffic sample zone. The traffic sample zone is defined by second boundary coordinates having been geometrically predetermined. The traffic sample zone is associated with traffic characteristics. The traffic characteristics are indicative of a maximum possible number of observers that can be located in the traffic sample zone at once. Each feedback signal comprises positional coordinates of a respective one of the first plurality of navigational devices.

The server is configured to process the feedback signals tracked for the first plurality of navigational devices. The server configured to process the feedback signals is further configured to determine an actual number of feedback observers located in the traffic sample zone at a first moment in time by comparing the positional coordinates of each one of the first plurality of navigational devices against the second boundary coordinates at the first moment in time.

The server configured to process the feedback signals is further configured to compute a fill rate parameter of the traffic sample zone at the first moment in time based on (i) the positional coordinates of at least one navigational device within the second boundary coordinates, (ii) the second boundary coordinates and (iii) the traffic characteristics. The fill rate parameter is indicative of an estimated total number of observers located in the traffic sample zone at the first moment in time.

The server configured to process the feedback signals is further configured to determine a feedback ratio associated with the traffic sample zone and which is a ratio between (i) the estimated total number of observers located in the traffic sample zone and (ii) the actual number of feedback observers located in the traffic sample zone. The feedback ratio is indicative of an estimated proportion of feedback observers and of non-feedback observers located in the traffic sample zone.

The server is also configured to determine an actual number of feedback observers located in the exposure zone based on a feedback signal of each one of a second plurality of navigational devices entering the exposure zone The server is also configured to determine the exposure parameter for the VPOI based on (i) the actual number of feedback observers in the exposure zone and (ii) the feedback ratio. The exposure parameter is indicative of an estimated number of observers that possibly viewed the VPOI.

In some embodiments of the server, The server is further configured to provide to the navigational devices information associated with the first and second boundary coordinates.

In some embodiments of the server, the traffic characteristics comprise a first type of traffic characteristic and a second type of traffic characteristic.

In some embodiments of the server, the first type of traffic characteristic is a vehicle-specific traffic characteristic and the second type of traffic characteristic is a zone-specific traffic characteristic.

It is contemplated that in some embodiments of the server, each feedback observer is associated with a respective feedback vehicle and a respective navigational device and that each non-feedback observer is associated with a respective non-feedback vehicle.

In some embodiments of the server, the vehicle-specific traffic characteristic comprises an average size of vehicles.

In some embodiments of the server, the zone-specific traffic characteristic comprises:

- an area overlapped by the traffic sample zone;
- a number of traffic lanes overlapped by the traffic sample zone;
- a traffic direction in the traffic sample zone; and
- an average vehicle-to-vehicle distance in the traffic sample zone.

In some embodiments of the server, the server configured to compute the fill rate parameter is further configured to identify rearmost positional coordinates amongst the positional coordinates of the at least one navigational device within the second boundary coordinates. The rearmost positional coordinates are the positional coordinates of a rearmost navigational device amongst the at least one navigational device within the second boundary coordinates according to the traffic direction in the traffic sample zone.

In some embodiments of the server, the server configured to identify the rearmost positional coordinates amongst the positional coordinates of the at least one navigational device within the second boundary coordinates is further configured to determine at least one of (i) traffic-entering boundary coordinates within the second boundary coordinates and (ii) traffic-exiting boundary coordinates within the second boundary coordinates based on the traffic direction in the traffic sample zone. The server configured to identifying the rearmost positional coordinates is further configured to compare each of the positional coordinates of the at least one navigational device within the second boundary coordinates against the at least one of (i) the traffic-entering boundary coordinates and (ii) the traffic-exiting boundary coordinates. The server configured to identify the rearmost positional coordinates is further configured to select a given one of the positional coordinates of the at least one navigational device as the rearmost positional coordinates such that the given one of the positional coordinates is at least one of (i) closest positional coordinates amongst the positional coordinates of the at least one navigational device to the traffic-entering boundary coordinates and (ii) farthest positional coordinates amongst the positional coordinates of the at least one navigational device from the traffic-exiting boundary coordinates.

In some embodiments of the server, the server configured to compute the fill rate parameter based on the rearmost positional coordinates amongst the positional coordinates of the at least one navigational device within the second boundary coordinates is further configured to compute the fill rate parameter such that to maximize the estimated total number of observers located in the traffic sample zone in comparison with any other fill rate parameter if computed based on any other positional coordinates amongst the positional coordinates of the at least one navigational device within the second boundary coordinates.

It is contemplated that the estimated total number of observers located in the traffic sample zone may be equal to the estimated total number of vehicles located in the traffic sample zone since each observer is associated with a respective vehicle.

In some embodiments of the server, the server configured to compute the fill rate parameter is further configured to determine an estimated number of observer located in a same traffic lane as the rearmost navigational device and located in the traffic sample zone based on (i) the rearmost positional coordinates, (ii) the average size of vehicles, and (iii) the average vehicle-to-vehicle distance in the traffic sample zone. The server configured to compute the fill rate parameter is further configured to multiply the estimated number of observer located in the same traffic lane as the rearmost navigational device and located in the traffic sample zone by the number of traffic lanes overlapped by the traffic sample zone.

In some embodiments of the server, the server configured to determine the actual number of feedback observers located in the exposure zone and to determine the exposure parameter for the VPOI is further configured to determine the actual number of feedback observers located in the exposure zone and to determine the exposure parameter for the VPOI at a second moment in time that is later in time than the first moment in time.

In some embodiments of the server, the feedback ratio is updated by the server on a periodic basis.

In some embodiments of the server, the exposure zone at least partially overlaps the traffic sample zone.

In some embodiments of the server, the first plurality of navigational devices comprises at least one navigational device amongst the second plurality of navigational devices.

In some embodiments of the server, the server is further configured to dynamically update the boundary coordinates of the exposure zone for the second moment in time based on camera data.

In the context of the present specification, a "server" is a computer program that is running on appropriate hardware and is capable of receiving requests (e.g. from client devices) over a network, and carrying out those requests, or causing those requests to be carried out. The hardware may be implemented as one physical computer or one physical computer system, but neither is required to be the case with respect to the present technology. In the present context, the use of the expression a "server" is not intended to mean that every task (e.g. received instructions or requests) or any particular task will have been received, carried out, or caused to be carried out, by the same server (i.e. the same software and/or hardware); it is intended to mean that any number of software elements or hardware devices may be involved in receiving/sending, carrying out or causing to be carried out any task or request, or the consequences of any task or request; and all of this software and hardware may be one server or multiple servers, both of which are included within the expression "at least one server".

In the context of the present specification, "electronic device" is any computer hardware that is capable of running software appropriate to the relevant task at hand. In the context of the present specification, the term "electronic device" implies that a device can function as a server for other electronic devices and client devices, however it is not required to be the case with respect to the present technology. Thus, some (non-limiting) examples of electronic devices include personal computers (desktops, laptops, netbooks, etc.), smart phones, and tablets, as well as network equipment such as routers, switches, and gateways. It should be understood that in the present context the fact that the device functions as an electronic device does not mean that it cannot function as a server for other electronic devices. The use of the expression "an electronic device" does not preclude multiple client devices being used in receiving/sending, carrying out or causing to be carried out any task or request, or the consequences of any task or request, or steps of any method described herein.

In the context of the present specification, "client device" is any computer hardware that is capable of running software appropriate to the relevant task at hand. In the context of the present specification, in general the term "client device" is associated with a user of the client device. Thus, some (non-limiting) examples of client devices include personal computers (desktops, laptops, netbooks, etc.), smart phones, and tablets, as well as network equipment such as routers, switches, and gateways It should be noted that a device acting as a client device in the present context is not precluded from acting as a server to other client devices. The use of the expression "a client device" does not preclude multiple client devices being used in receiving/sending, carrying out or causing to be carried out any task or request, or the consequences of any task or request, or steps of any method described herein.

In the context of the present specification, the expression "information" includes information of any nature or kind whatsoever capable of being stored in a database. Thus information includes, but is not limited to audiovisual works (images, movies, sound records, presentations etc.), data (location data, numerical data, etc.), text (opinions, comments, questions, messages, etc.), documents, spreadsheets, etc.

In the context of the present specification, the expression "software component" is meant to include software (appropriate to a particular hardware context) that is both necessary and sufficient to achieve the specific function(s) being referenced.

In the context of the present specification, the expression "computer information storage media" (also referred to as "storage media") is intended to include media of any nature and kind whatsoever, including without limitation RAM, ROM, disks (CD-ROMs, DVDs, floppy disks, hard drivers, etc.), USB keys, solid state-drives, tape drives, etc. A plurality of components may be combined to form the computer information storage media, including two or more media components of a same type and/or two or more media components of different types.

In the context of the present specification, a "database" is any structured collection of data, irrespective of its particular structure, the database management software, or the computer hardware on which the data is stored, implemented or otherwise rendered available for use. A database may reside on the same hardware as the process that stores or makes use of the information stored in the database or it may reside on separate hardware, such as a dedicated server or plurality of servers.

In the context of the present specification, the words "first", "second", "third", etc. have been used as adjectives only for the purpose of allowing for distinction between the nouns that they modify from one another, and not for the purpose of describing any particular relationship between those nouns. Thus, for example, it should be understood that, the use of the terms "first database" and "third server" is not intended to imply any particular order, type, chronology, hierarchy or ranking (for example) of/between the server, nor is their use (by itself) intended imply that any "second server" must necessarily exist in any given situation. Further, as is discussed herein in other contexts, reference to a "first" element and a "second" element does not preclude the two elements from being the same actual real-world element. Thus, for example, in some instances, a "first" server and a "second" server may be the same software and/or hardware components, in other cases they may be different software and/or hardware components.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

These and other features, aspects and advantages of the present technology will become better understood with regard to the following description, appended claims and accompanying drawings where:

DETAILED DESCRIPTION

Figure 1:
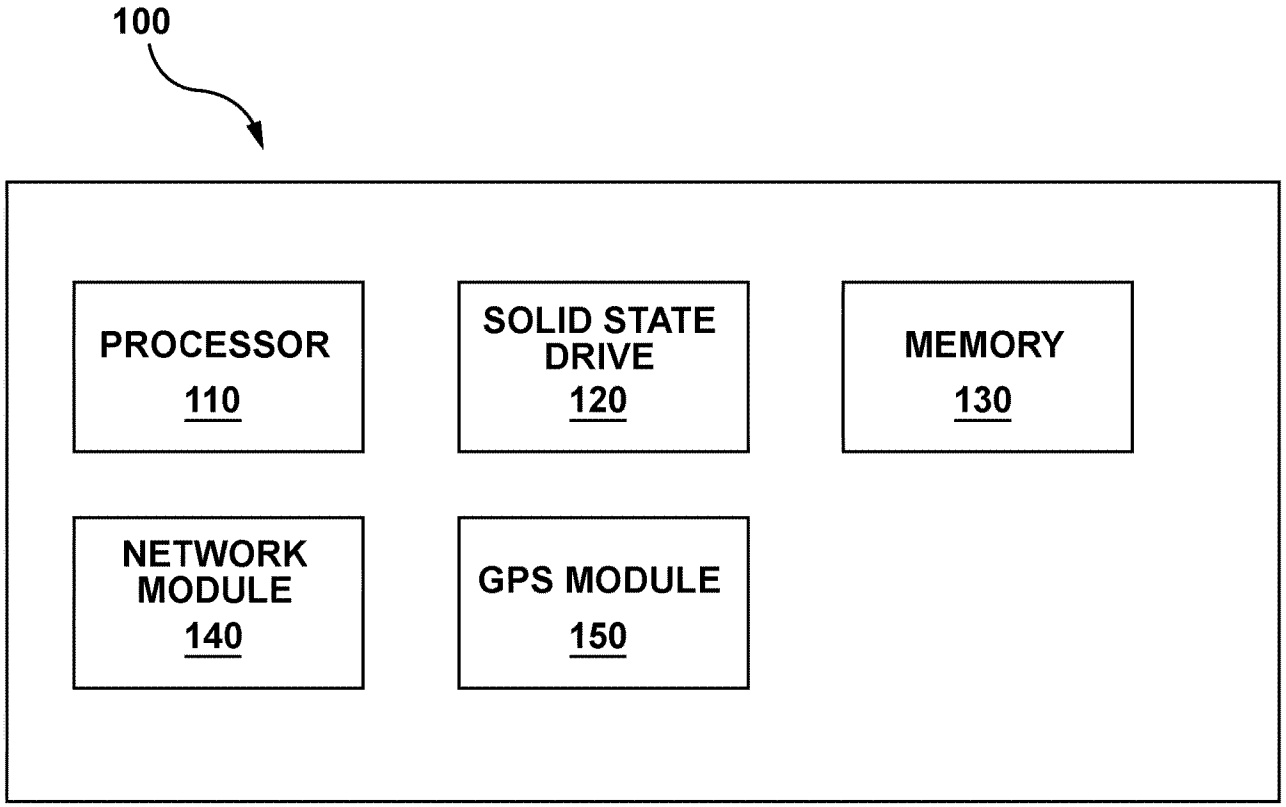
FIG. 1 depicts a schematic diagram of an example computer system for implementing certain embodiments of systems and/or methods of the present technology.

The examples and conditional language recited herein are principally intended to aid the reader in understanding the principles of the present technology and not to limit its scope to such specifically recited examples and conditions. It will be appreciated that those skilled in the art may devise various arrangements which, although not explicitly described or shown herein, nonetheless embody the principles of the present technology and are included within its spirit and scope.

Furthermore, as an aid to understanding, the following description may describe relatively simplified implementations of the present technology. As persons skilled in the art would understand, various implementations of the present technology may be of a greater complexity.

In some cases, what are believed to be helpful examples of modifications to the present technology may also be set forth. This is done merely as an aid to understanding, and, again, not to define the scope or set forth the bounds of the present technology. These modifications are not an exhaustive list, and a person skilled in the art may make other modifications while nonetheless remaining within the scope of the present technology. Further, where no examples of modifications have been set forth, it should not be interpreted that no modifications are possible and/or that what is described is the sole manner of implementing that element of the present technology.

Moreover, all statements herein reciting principles, aspects, and implementations of the technology, as well as specific examples thereof, are intended to encompass both structural and functional equivalents thereof, whether they are currently known or developed in the future. Thus, for example, it will be appreciated by those skilled in the art that any block diagrams herein represent conceptual views of illustrative circuitry embodying the principles of the present technology. Similarly, it will be appreciated that any flowcharts, flow diagrams, state transition diagrams, pseudocode, and the like represent various processes which may be substantially represented in computer-readable media and so executed by a computer or processor, whether or not such computer or processor is explicitly shown.

The functions of the various elements shown in the figures, including any functional block labelled as a "processor", may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, network processor, application-specific integrated circuit (ASIC), field programmable gate array (FPGA), read-only memory (ROM) for storing software, random access memory (RAM), and non-volatile storage. Other hardware, conventional and/or custom, may also be included.

Software modules, or simply modules which are implied to be software, may be represented herein as any combination of flowchart elements or other elements indicating performance of process steps and/or textual description. Such modules may be executed by hardware that is expressly or implicitly shown.

With these fundamentals in place, we will now consider some non-limiting examples to illustrate various implementations of aspects of the present technology.

With reference to FIG. 1, there is shown a computer system 100 suitable for use with some implementations of the present technology, the computer system 100 comprising various hardware components including one or more single or multi-core processors collectively represented by processor 110, a solid-state drive 120, a memory 130, which may be a random-access memory, a network module 140, and a GPS module 150. Communication between the various components of the computer system 100 may be enabled by one or more internal and/or external buses (not shown) (e.g. a PCI bus, universal serial bus, IEEE 1394 "Firewire" bus, SCSI bus, Serial-ATA bus, etc.), to which the various hardware components are electronically coupled. According to embodiments of the present technology, the solid-state drive 120 stores program instructions suitable for being loaded into the memory 130 and executed by the processor 110 for displaying information to a user of the computer system 100 as will be described in further detail below. For example, the program instructions may be part of a mapping or navigational application executable by the processor 110. The network module 140 and the GPS module 150 allow communication between different computer systems, servers and/or other devices.

Figure 2:
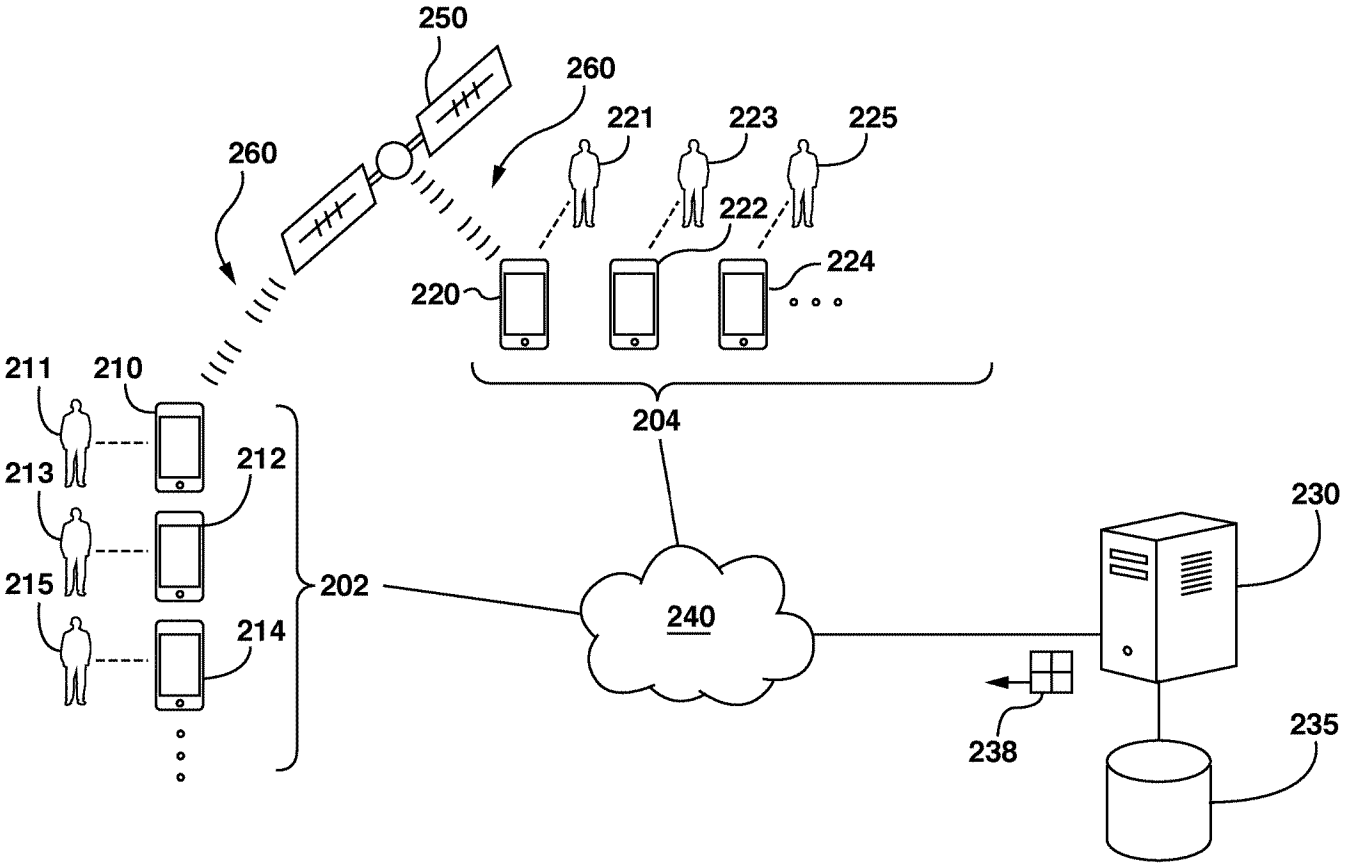
FIG. 2 depicts a networked computing environment being suitable for use with some implementations of the present technology.

FIG. 2 illustrates a networked computing environment 200 suitable for use with some embodiments of the systems and/or methods of the present technology. The networked computing environment 200 comprises a first plurality of navigational devices 202, and a second plurality of navigational devices 204. The first plurality of navigational devices 202 comprises at least navigational devices 210, 212 and 214 respectively associated with users 211, 213 and 215. The second plurality of navigational devices 204 comprises at least navigational devices 220, 222 and 224 respectively associated with users 221, 223 and 225. As it will be described herein below, each one of the users 211, 213, 215, 221, 223 and 225 may operate a respective vehicle (not depicted).

It should be noted that although each of the first and the second pluralities of navigational devices 202 and 204 was depicted as comprising three distinct navigational devices, this may not be the case in each and every implementation of the present technology. In fact, each one of the first and the second pluralities of navigational devices 202 and 204 may comprise a larger number of navigational devices such as 100, 1000, 10000, 1000000, and the like. It is also contemplated that, in some embodiments of the present technology, the first plurality of navigational devices 202 may comprise at least one navigational device from the second plurality of navigational devices 204.

The networked computing environment 200 also comprises a server 230 in communication with the first and second pluralities of navigational devices 202 and 204 via a communications network 240 (e.g. the Internet or the like, as will be described in greater detail herein below), and a GPS satellite 250 transmitting and/or receiving a GPS signal 260 to/from each one of the first and second pluralities of navigational devices 202 and 204. It will be understood that the present technology is not limited to GPS and may employ a positioning technology other than GPS.

The implementation of a given navigational device from any one of the first and the second pluralities of navigational devices 202 and 204 is not particularly limited, but as an example, the given navigational device may be implemented as a wireless communication device such as a mobile telephone (e.g. a smart phone or a radio-phone), a vehicle navigation device (e.g. TomTom™, Garmin™), a tablet, a personal computer and the like. However in FIG. 2, each given navigational device is depicted as the smart phone.

The given navigational device may comprise some or all of the components of the computer system 100 depicted in FIG. 1. In some embodiments, the given navigational device comprises the network module 140 for communicating with the server 230 via the communications network 240, the GPS module 150 for receiving and transmitting the GPS signal 260 to the GPS satellite 250 (i.e., for enabling GPS capabilities of the given navigational device), the processor 110, the memory 130, and a display interface such as a touch-screen for example. The given navigational device comprises hardware and/or software and/or firmware, or a combination thereof, for providing feedback signals to the server 230 via the communications network 240.

Generally speaking, a given feedback signal provided by a given navigational device to the server 230 may comprise device-navigational information monitored and collected by the given navigational device as the navigational device moves. In other words, as the given navigational device moves, the given navigational device may monitor and collect device-navigational information regarding its movement from one place to another. The given navigational device may be enabled to monitor and collect device-navigational information regarding its movement via its GPS capabilities. As an example, the given navigational device may monitor and collect: positional coordinates, speed, acceleration, orientation, and the like. The given navigational device may be configured to execute monitoring and collecting the data over a period of time. This means that, for each given moment in time, the navigational device may monitor and collect its positional coordinates, its speed, its acceleration, its orientation and the like.

The given navigational device may be configured to provide a respective feedback signal, to the server 230, which comprises device-navigational information about the given navigational device. The provision of the respective feedback signal to the server 230 may be executed continuously while the given navigational device is moving. Alternatively, the provision of the respective feedback signal to the server 230 may be executed upon a feedback signal trigger. For example, upon a given navigational device determining that it is approaching certain predetermined coordinates, the navigational device may trigger the generation and the provision of the respective feedback signal. How the feedback signal trigger is implemented in some embodiments of the present technology will be further described herein below.

As previously mentioned, each given user and, therefore, each given navigational device may be permanently or temporarily associated with a respective vehicle. A given vehicle may comprise any leisure or transportation vehicle such as a private or commercial car, truck, motorbike or the like. The given vehicle may be user operated or, in some embodiments of the present technology, a driver-less vehicle. As previously mentioned, a given user associated with a respective vehicle may also be associated with a respective navigational device. It should be noted that the fact that the given navigational device is associated with the respective user does not need to suggest or imply any mode of operation—such as a need to log in, a need to be registered or the like. Similarly, the fact that the given navigational device is associated with the respective vehicle does not need to suggest or imply any mode of operation. In other words, the associations between the given user, the respective vehicle and the respective navigational device denote the assumption that the given user may interact with the respective navigational device and is travelling in the respective vehicle with the respective navigational device.

It should be noted that vehicles that are associated with respective navigational devices are referred herein as "feedback vehicles", as opposed to vehicles which are not associated with navigational devices. The vehicles which are not associated with navigational devices are referred herein as "non-feedback vehicles".

Since feedback vehicles are associated with respective navigational devices, the server 230 may be provided with respective feedback signals from the respective navigational devices which are indicative, not only of the device-navigational information but also, of vehicle-navigational information. In other words, the device-navigational information about a given navigational device is identical to the vehicle-navigational information about the respective feedback vehicle since the movement of each navigational device is identical to the movement of the respective feedback vehicle (i.e., a given navigational device is in the respective feedback vehicle when the respective feedback vehicle travels from one place to another). Therefore, the feedback signal provided by a given navigational device may be indicative of the movement of a respective feedback vehicle.

On the other hand, non-feedback vehicles are not associated with respective navigational devices. As a result, the server 230 is not provided with information indicative of movement of the non-feedback vehicles. Put another way, the server 230 is unaware of the vehicle-navigational information about the non-feedback vehicles.

In some embodiments of the present technology, the communications network 240 is the Internet. In alternative non-limiting embodiments, the communication network can be implemented as any suitable local area network (LAN), wide area network (WAN), a private communication network or the like. It should be expressly understood that implementations for the communication network are for illustration purposes only. How a communication link (not separately numbered) between a given navigational device and the communications network 240 is implemented will depend inter alia on how the given navigational device is implemented.

Merely as an example and not as a limitation, in those embodiments of the present technology where the given navigational device is implemented as a wireless communication device such as a smart phone, the communication link can be implemented as a wireless communication link. Examples of wireless communication links include, but are not limited to, a 3G communication network link, a 4G communication network link, and the like. The communications network 240 may also use a wireless connection with the server 230.

A database 235 is communicatively coupled to the server 230 but, in alternative implementations, the database 235 may be communicatively coupled to the server 230 via the communications network 240 without departing from the teachings of the present technology. Although the database 235 is illustrated schematically herein as a single entity, it is contemplated that the database 235 may be configured in a distributed manner, for example, the database 235 could have different components, each component being configured for a particular kind of retrieval therefrom or storage therein.

The database 235 may be a structured collection of data, irrespective of its particular structure or the computer hardware on which data is stored, implemented or otherwise rendered available for use. The database 235 may reside on the same hardware as a process that stores or makes use of the information stored in the database 235 or it may reside on separate hardware, such as on the server 230. Generally speaking, the database 235 may receive data from the server 230 for storage thereof and may provide stored data to the server 230 for use thereof.

In some embodiments of the present technology, the server 230 may be configured to store in the database 235 information related to one or more navigational services hosted by the server 230. At least some information stored in the database 235 may be predetermined by an operator of the one or more navigational services and/or collected from a plurality of external resources. It is contemplated that the database 235 may be configured to store information related to users of the one or more navigational services as well as information related to the first and second pluralities of navigational devices 202 and 204. What kind of predetermined information may be stored in the database 235 will be further described herein below.

In some embodiments of the present technology, the server 230 is implemented as a conventional computer server. In one non-limiting example, the server 230 is implemented as a Dell™ PowerEdge™ Server running the Microsoft™ Windows Server™ operating system, but can also be implemented in any other suitable hardware, software, and/or firmware, or a combination thereof. In the depicted non-limiting embodiments of the present technology, the server is a single server. In alternative non-limiting embodiments of the present technology (not shown), the functionality of the server 230 may be distributed and may be implemented via multiple servers.

In some embodiment of the present technology, the server 230 comprises hardware and/or software and/or firmware, or a combination thereof, for generating a traffic prediction for a given zone. In other embodiments, the server 230 comprises hardware and/or software and/or firmware, or a combination thereof, for determining an exposure parameter for a visual point of interest (VPOI).

As previously mentioned, the server 230 may host the one or more navigational services that provide navigational information to various navigational devices. Indeed, the one or more navigational services of the server 230 may allow access to information related to users of the one or more navigational services. The one or more navigational services of the server 230 may also implement a traffic prediction algorithm (not depicted), such as a machine-learning model for example, for determining at least some navigational information. In some embodiments, merely as an illustration and not a limitation, the navigational service of the server 230 that provides the navigational information is Yandex™ Maps.

Figure 3:
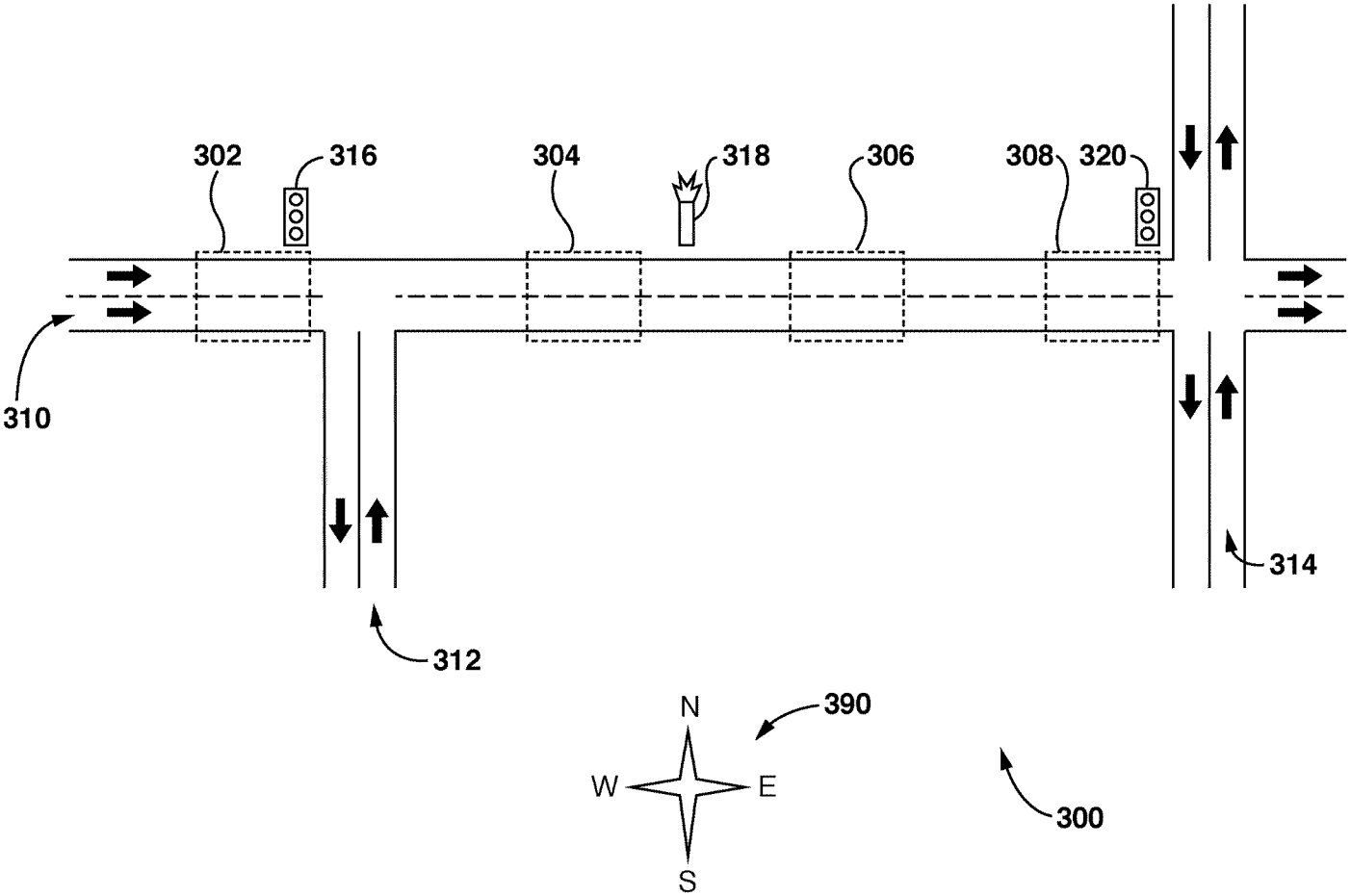
FIG. 3 depicts a map illustration representing a plurality of zones, which are processed by a server of FIG. 1, and visual points of interests (VPOIs) according to some implementations of the present technology.

With reference to FIG. 3, there is depicted a map illustration 300 and a compass 390 defining a magnetic-type orientation referential of the map illustration 300. The magnetic-type orientation referential is arbitrarily defined for illustration purposes only. The map illustration 300 comprises a first road segment 310, a second road segment 312 and a third road segment 314. Each one of the first, second and third road segments 310, 312 and 314 may be associated with a number of traffic lanes and respective traffic directions. Such information about the first, second and third road segments 310, 312 and 314 may be accessible via the navigational service of the server 230.

For example, the first road segment 310 has two traffic lanes which are both associated with the East-bound traffic direction (see bold arrows depicted on the traffic lanes of the first road segment 310). Also, the second road segment 312 has two traffic lanes where one traffic lane is associated with the North-bound traffic direction and which ends at the first road segment 310 and the other traffic lane is associated with the South-bound traffic direction which begins at the first road segment 310 (see bold arrows). The third road segment 314 also has two traffic lanes where one traffic lane is associated with the North-bound traffic direction and which intersects the first road segment 310 and the other traffic lane is associated with the South-bound traffic direction and which also intersects the first road segment 310 (see bold arrows).

A given user in a respective vehicle travelling along the first road segment 310 from the West to the East may approach a first traffic light 316 and may choose to (i) turn Right at the second road segment 312 onto the traffic lane of the second road segment 312 that is associated with the South-bound traffic direction, or (ii) continue travelling along the first road segment 312 towards a VPOI 318.

Generally speaking, a given VPOI may be any visual entity which could possibly be observable and recognizable by the given user. For example, the given VPOI may be an architectural building, a road traffic signalization, an electronic billboard, etc. The given VPOI can be located near roadways, airports, hotels, shopping centers, etc. As such, it is contemplated that the first traffic light 316 and a second traffic light 320 may also be VPOIs that a given user can possibly see and recognize, without departing from the scope of the present technology.

In the case where the given user in the respective vehicle passes the first traffic light 316 and continues travelling along the first road segment 310 towards the VPOI 318, the given user may continue travelling along the first road segment 310 and may approach the second traffic light 320. In such a case, the given user in the respective vehicle may choose to (i) continue travelling along the first road segment 310, or (ii) turn Right at the third road segment 314 onto the traffic lane of the third road segment 314 that is associated with the South-bound traffic direction, or (ii) turn Left at the third road segment 314 onto the traffic lane of the third road segment 314 that is associated with the North-bound traffic direction.

When the given user in the respective vehicle approaches any one of the first and second traffic lights 316 and 320 and when the given one of the first and second traffic lights 316 and 320 displays a stop indication (such as a red light), the given user in the respective vehicle will stop before the given one of the first and second traffic lights 316 and 320.

Also, a given user in a respective vehicle that is travelling North-bound on the second road segment 312 may turn Right at the first road segment 310 onto the first road segment 310 towards the VPOI 318. A given user in a respective vehicle travelling North-bound on the third road segment 314 may pass the first road segment 310 and continue travelling North-bound on the third road segment 314 or can choose to turn Right at the first road segment 310 onto the first road segment 310 towards the East. Also, a given user in a respective vehicle travelling South-bound on the third road segment 314 may pass the first road segment 310 and continue travelling South-bound on the third road segment 314 or can choose to turn Left at the first road segment 310 onto the first road segment 310 towards the East.

It should be appreciated that traffic conditions caused by a plurality of vehicles travelling along the first road segment 310 may occur for different reasons. For example, the traffic on the first road segment 310 may occur since more vehicles may travel along the first road segment 310 during rush hours than during night hours. In another example, the traffic on the first road segment 310 may occur since more vehicles may travel along the first road segment 310 when an accident occurs on a nearby road segment and when the traffic on the nearby road segment is redirected towards the first road segment 310. Also, the traffic on the first road segment 310 may occur since more vehicles may travel along the first road segment 310 on weekdays than on weekends. Irrespective of a particular reason why traffic on a given road segment occurs, it should be appreciated that predicting traffic on the given road segment at a given time may be beneficial. Indeed, a given user may decide, based on the predicted traffic, whether (s)he will take the given road segment for travelling from one place to another, or whether (s)he should take an alternative route in order to arrive at the destination.

Developers of the present technology have appreciated that generating a traffic prediction that takes into account solely the feedback vehicles may be prone to significant estimation errors since non-feedback vehicles may considerably affect the traffic on a given route. Indeed, although traffic prediction for the given route caused by feedback vehicles may be executed based on the respective feedback signals of the respective navigational devices, traffic prediction for the given route caused by a plurality of vehicles that comprises both the feedback vehicles and the non-feedback vehicles may be difficult to achieve since the non-feedback vehicles are not associated with respective navigational devices and the server 230 therefore lacks vehicle-navigational information about the non-feedback vehicles. As such, there is a need for methods and systems that are configured to generate traffic predictions that take into account both the feedback vehicles and the non-feedback vehicles.

In accordance with some embodiments of the present technology, methods and systems are described for improving the generation of traffic predictions. At least some embodiments of the present technology allow generating traffic predictions based on a total number of vehicles causing the traffic condition—i.e. both feedback vehicles and non-feedback vehicles.

In some embodiments of the present technology, the server 230 may be configured to predict traffic caused by the plurality of vehicles that comprises the feedback vehicles and the non-feedback vehicles by inter alia processing feedback signals associated with the feedback vehicles. How the server 230 may predict traffic caused by this plurality of vehicles based on the feedback signals will now be described.

In FIG. 3, there is depicted a traffic sample zone 302, an exposure zone 304, a target zone 306 and a traffic sample zone 308. The traffic sample zone 302 is located adjacent to the first traffic light 316 on the West-side thereof and overlaps the first road segment 310. The target zone 306 is located between the VPOI 318 and the second traffic light 320 and overlaps the first road segment 310. The traffic sample zone 308 is located adjacent to the second traffic light 320 on the West-side thereof and overlaps the first road segment 310. The exposure zone 304 is located in visual proximity to the VPOI 318 and overlaps the first road segment 310.

It is contemplated that any two of the traffic sample zone 302, the exposure zone 304, the target zone 306 and the traffic sample zone 308 may at least partially overlap each other, without departing from the scope of the present technology. Moreover, although the traffic sample zones 302 and 308 are depicted as being adjacent to the first and second traffic lights 316 and 320, this might not be the case in each and every implementation, and without departing from the scope of the present technology.

Each one of the traffic sample zone 302, the exposure zone 304, the target zone 306 and the traffic sample zone 308 are defined by respective boundary coordinates. In other words, each one of the traffic sample zone 302, the exposure zone 304, the target zone 306 and the traffic sample zone 308 is associated with respective predetermined coordinates that define a respective perimeter of each one of the traffic sample zone 302, the exposure zone 304, the target zone 306 and the traffic sample zone 308. The boundary coordinates of each one of the traffic sample zone 302, the exposure zone 304, the target zone 306 and the traffic sample zone 308 may have been geometrically predetermined and stored in the database 235 prior to the processing of the feedback signals by the server 230.

In some embodiments of the present technology, the boundary coordinates each one of the traffic sample zone 302, the exposure zone 304, the target zone 306 and the traffic sample zone 308 may have been geometrically predetermined by the operator of the server 230 and stored by the server 230 in the database 235. For example, each one of the traffic sample zone 302, the exposure zone 304, the target zone 306 and the traffic sample zone 308 may have been predetermined by the operator based on geometrical principles.

In other embodiments, the boundary coordinates of at least one of the traffic sample zone 302, the exposure zone 304, the target zone 306, and the traffic sample zone 308 may have been geometrically predetermined based on at least a location of a given VPOI. For example, the boundary coordinates of the exposure zone 304 may have been geometrically predetermined based on at least the location of the VPOI 318.

Indeed, the location of the VPOI 318 and/or a size of the VPOI 318 may affect the visibility of the VPOI 318 if the VPOI 318 is located near a large building or a forest, for example. As such, based on the location of the VPOI 318, the operator may geometrically predetermine the boundary coordinates of the exposure zone 304 such that if a given user is located within the exposure zone 304, the VPOI 318 may be visible to the given user. In other words, when a given observer (i.e., the given user) is located in the exposure zone 304, the VPOI 318 is within the field of view of the given observer.

In additional embodiments, the boundary coordinates of at least one of the traffic sample zone 302, the exposure zone 304, the target zone 306, and the traffic sample zone 308 may have been geometrically predetermined based on at least a traffic-controlling nature of a given VPOI. For example, the boundary coordinates of the traffic sample zone 302 may have been geometrically predetermined to be in proximity to the first traffic light 316 based on the fact that the first traffic light 316 is of the traffic-controlling nature.

Indeed, the traffic-controlling nature of the first traffic light 316 may affect the predetermination of the traffic sample zone 302 since, due to the traffic-controlling nature of the first traffic light 316, traffic within the traffic sample zone 302 may be slowed down and stopped and, therefore, altered in a predictable manner if compared to another given zone which is in proximity to a given VPOI that is not of the traffic-controlling nature.

In some embodiments of the present technology, the boundary coordinates of at least one of the traffic sample zone 302, the exposure zone 304, the target zone 306, and the traffic sample zone 308 may be geometrically predetermined based on camera data. As will be described below, some or all of the traffic sample zone 302, the exposure zone 304, the target zone 306, and the traffic sample zone 308 may be updated/redefined from time to time.

For example, a given vehicle travelling along the first road segment 310 may be equipped with a camera or any other optical device for recording visual images in the form of photographs or video signals and which is also configured to store them locally and/or provide them to the server 230 for further processing thereof.

The camera may comprise a camera GPS module which operates and is configured similarly to the GPS module 150 of the computer system 100 (see FIG. 1). In some implementations the camera may be integrated in at least one of the first plurality of navigational device 202.

The camera may be equipped to the given vehicle in a specific position and with a specific orientation such that an angle of view of the camera is substantially similar to the field of view of a given observer (i.e., given user) being in the given vehicle. As such, when the given vehicle is approaching the VPOI 318, the camera may be configured to record video signals and, therefore, capture camera data representative of the surrounding environment which falls within its angle of view as the given vehicle approaches and eventually passes the VPOI 318. The camera data captured by the camera may be associated with positional coordinates of the camera as the camera approaches and eventually passes the VPOI 318.

The camera may be configured to provide the camera data with the associated positional coordinates to the server 230. The server 230 may be configured to analyse the camera data and the associated positional coordinates in order to determine the positional coordinates associated with camera data that is representative of at least the VPOI 318. In other words, the server 230 may be configured to determine from the camera data a subset of the camera data that is representative of at least the VPOI 318 (i.e., the subset of camera data corresponds to a portion of the camera data in which the VPOI 318 is visible) and may determine that the positional coordinates associated with the subset of the camera data define camera-bounding visibility coordinates. The server 230 may also verify whether the camera-bounding visibility coordinates correspond to the boundary coordinates of the exposure zone 304. The server 230 may determine the subset of camera data by implementing a variety of computer vision techniques.

In some embodiments of the present technology, the server 230 may be configured to dynamically update the boundary coordinates of the exposure zone 304 based on the camera-bounding visibility coordinates. Indeed, in some cases, the boundary coordinates of exposure zone 304 may change due to temporary and/or permanent obstructing objects that make the VPOI 318 less visible. As such, if the camera-bounding visibility coordinates do not correspond to current boundary coordinates of the exposure zone 304 at a given moment in time, the server 230 may be configured to update the boundary coordinates of the exposure zone 304 so as to correspond to the camera-bounding visibility coordinates at the given moment in time. This means, that at another given moment in time that is later in time than the given moment in time, the boundary coordinates of the exposure zone 304 may be dynamically updated so as to correspond to the camera-bounding visibility coordinates.

It should be noted that, although each one of the traffic sample zone 302, the exposure zone 304, the target zone 306 and the traffic sample zone 308 is depicted as having a rectangular shape, this might not be so in each and every implementation of the present technology. For example, at least one of the traffic sample zone 302, the exposure zone 304, the target zone 306 and the traffic sample zone 308 may be defined by respective boundary coordinates which outline a different shape other than a rectangular shape.

Each one of the traffic sample zone 302, the exposure zone 304, the target zone 306 and the traffic sample zone 308 is associated with respective traffic characteristics. The traffic characteristics may be indicative of a maximum possible number of vehicles that can be located in the given zone at once.

In some embodiments of the present technology, the server 230 may be configured to predetermine and store in the database 235 information regarding the boundary coordinates of each one of the traffic sample zone 302, the exposure zone 304, the target zone 306 and the traffic sample zone 308 in association with information regarding the respective traffic characteristics. This means that the traffic characteristics may be predetermined such that they are determined by the server 230 prior to processing of the feedback signals by the server 230. These traffic characteristics may comprise a first type of traffic characteristic and a second type of traffic characteristic.

The first type of traffic characteristic may be a vehicle-specific traffic characteristic associated with typical vehicles travelling through a respective zone. The vehicle-specific traffic characteristic may comprise an average size of vehicles. The average size of vehicles may be computed statistically by averaging lengths and widths of a large number of vehicles that travel along the first road segment 310, for example. In some implementations, the average size of vehicles is 4.5 meters in length and 1.8 meters in width. However, it is contemplated that other lengths and widths may be used to define the average size of vehicles depending on inter alia typical vehicles travelling through the respective zone.

The second type of traffic characteristic may be a zone-specific traffic characteristic. The zone-specific traffic characteristic may comprise an area size overlapped by a given zone, a number of traffic lanes overlapped by the given zone, a traffic direction in the given zone, an average vehicle-to-vehicle distance in the given zone and the like.

The area size overlapped by the given zone may be computed based on the respective boundary coordinates of the given zone that corresponds to a surface occupied by the given zone. Many known techniques may be used to predetermine the area size overlapped by the given zone.

The number of traffic lanes overlapped by the given zone may also be predetermined based on the boundary coordinates of the given zone. In FIG. 3, each one of the traffic sample zone 302, the exposure zone 304, the target zone 306 and the traffic sample zone 308 overlaps two traffic lanes. However, this might not be the case in each and every implementation of the present technology. For example, the given zone may overlap one, three, four or five lanes, for example. The number of traffic lanes overlapped by the given zone will depend on the respective boundary coordinates having been geometrically predetermined for the given zone.

The traffic direction in the given zone depends on a given road segment that the given zone overlaps. For example, if the given zone overlaps traffic lanes that allow traffic to move along the East-bound traffic direction, the traffic direction in the given zone may be indicative of that traffic enters the given zone from the West-side of the given zone and exits the given zone from the East-side of the given zone. In another example, if the given zone overlaps traffic lanes that allow traffic to move along the North-bound traffic direction, the traffic direction in the given zone may be indicative of that traffic enters the given zone from the South-side of the given zone and exits the given zone from the North-side of the given zone. In other words, the traffic direction in the given zone may be predetermined based on the traffic direction of traffic lanes of the given road segment that the given zone overlaps.

Generally speaking, a vehicle-to-vehicle distance corresponds to a distance that separates two consecutive vehicles travelling in a same traffic lane. The average vehicle-to-vehicle distance in the given zone may be predetermined based on an average speed of vehicles in the given zone. Generally speaking, the vehicle-to-vehicle distance varies according to speed of vehicles, such that the vehicle-to-vehicle distance is a function of the speed of vehicles. When vehicles in traffic are travelling at low speeds, the vehicle-to-vehicle distance between them generally tends to be small, whereas vehicles that travel at higher speeds in traffic generally tend to have longer distances between each other.

The average speed of vehicles at a given moment in time in the given zone may be predetermined at least partially based on the location of the given zone. For example, the traffic sample zone 302 is located adjacent to the first traffic light 316 on the West-side thereof and overlaps the first road segment 310. As such, at a given moment in time when the first traffic light 316 displays the stop indication, vehicles that are approaching the first traffic light 316 will slow down and eventually stop before the first traffic light 316 in the traffic lanes overlapped by the traffic sample zone 302. This means that at the given moment in time, the average speed of vehicles in the traffic sample zone 302 is very low and, therefore, the average vehicle-to-vehicle distance in the traffic sample zone 302 at the given moment in time is small. In some implementations, at a given moment in time, the average vehicle-to-vehicle distance in the traffic sample zone 302 may be 0.5 meters but, may be different in other implementations.

In another example, the target zone 306 is located remotely from the first traffic light 316 and from the second traffic light 320. As such, vehicles that were stopped at the first traffic light 316 have had enough time to pick up speed when approaching the target zone 306 and are still far enough from the second traffic light 320 for having to break. This means that the average speed of vehicles in the target zone 306 is fairly high and, therefore, the average vehicle-to-vehicle distance in the target zone 306 is high or otherwise higher than the average vehicle-to-vehicle distance in the traffic sample zone 302. In some implementations, at a given moment in time, the average vehicle-to-vehicle distance in the target zone 306 may be 1 meter but, may be different in other implementations.

In some embodiments of the present technology, the server 230 may be configured to provide the boundary coordinates of each one of the traffic sample zone 302, the exposure zone 304, the target zone 306 and the traffic sample zone 308 to each navigational device that uses the one or more navigational services of the server 230. For example, the server 230 may generate a plurality of boundary-trigger data packets 238 (see FIG. 2, for example) comprising information indicative of the boundary coordinates of each one of the traffic sample zone 302, the exposure zone 304, the target zone 306 and the traffic sample zone 308 and may send the plurality of boundary-trigger data packets 238 over the communications network 240 such that a respective boundary-trigger data packet within the plurality of boundary-trigger data packets 238 is transmitted to a respective navigational device that uses the one or more navigational service of the server 230.

Additionally, each boundary-trigger data packet comprises computer-readable instructions that, when executed by a respective navigational device, may trigger the respective navigational device to generate and provide a respective feedback signal to the server 230 upon the respective navigational device approaching any of the respective boundary coordinates of the traffic sample zone 302, the exposure zone 304, the target zone 306 and the traffic sample zone 308 (i.e., the feedback signal trigger).

In other words, after receiving a given boundary-trigger data packet, a given navigational device has access to information indicative of the boundary coordinates of each one of the traffic sample zone 302, the exposure zone 304, the target zone 306 and the traffic sample zone 308. Also, after receiving the given boundary-trigger data packet, when the positional coordinates of the given navigational device, which are being monitored and collected by the given navigational device, are in close proximity to the boundary coordinates of any one of the traffic sample zone 302, the exposure zone 304, the target zone 306 and the traffic sample zone 308, the given navigational device may generate a respective feedback signal and may provide it to the server 230. It should be noted that the positional coordinates of the given navigational device are in close proximity to given boundary coordinates when the given navigational device is approaching and/or entering the respective zone associated with the given boundary coordinates.

Let it be assumed that the first plurality of navigational devices 202 is approaching the traffic sample zone 302. As previously mentioned, based on the respective boundary-trigger data packets that each one of the first plurality of navigational devices 202 received from the server 230, each one of the first plurality of navigational devices 202 is thereby triggered to generate and provide a respective feedback signal to the server 230.

This means that, in some embodiments, each one of the first plurality of navigational devices 202 may act as "a proxy" between the GPS satellite 250 and the server 230 for relaying information from the GPS satellite about the respective one of the plurality of navigational devices 202 to the server 230 upon the respective one of the first plurality of navigational devices 202 approaching the traffic sample zone 302.

The provision of respective feedback signals of the first plurality of navigational devices 202 enables the server 230 to identify the positional coordinates of each one of the first plurality of navigational devices 202. In some embodiments, the server 230 may be configured to track the respective feedback signals of each one of the first plurality of navigational devices 202 and, therefore, the server 230 may be configured to track the respective positional coordinates of each one of the first plurality of navigational devices 202 as they move through the traffic sample zone 302.

In some embodiments, tracking of the feedback signals of the first plurality of navigational devices 202 may comprise storing the information provided via these feedback signals (i.e., including the positional coordinates of the first plurality of navigational devices 202) in the database 235 for further processing thereof.

As previously mentioned, the server 230 may be configured to process the feedback signals tracked for the first plurality of navigational devices 202. Generally speaking, during processing of the feedback signals, the server 230 may (i) determine an actual number of feedback vehicles located in the traffic sample zone 302, (ii) compute a fill rate parameter of the traffic sample zone 302 at a given moment in time, and (iii) determine a feedback ratio associated with the traffic sample zone 302.

The processing of the feedback signals tracked for the first plurality of navigational devices 202 by the server 230 may allow the server 230 to generate a given traffic prediction at another given moment in time for any one of the traffic sample zone 302, the exposure zone 304, the target zone 306 and the traffic sample zone 308. Some implementations of the processing of the feedback signals tracked for the first plurality of navigational devices 202 by the server 230 will now be described in further detail.

As previously mentioned, during the processing of the feedback signals tracked for the first plurality of navigational devices 202, the server 230 may be configured to determine the actual number of feedback vehicles in the traffic sample zone 302 at a given moment in time.

In some embodiments of the present technology, the server 230 may determine for a given moment in time the actual number of feedback vehicles in the traffic sample zone 302 by identifying a total number of distinct feedback signals being provided thereto by the first plurality of navigational devices 202. Indeed, since each one of the first plurality of navigational devices 202 is triggered to provide a respective feedback signal to the server 230 upon entering and/or approaching the traffic sample zone 302, the number of feedback signals provided to the server 230 is equal to the actual number of feedback vehicles entering and/or approaching the traffic sample zone 302.

In other embodiments of the present technology, the server 230 may determine the actual number of feedback vehicles in the traffic sample zone 302 by comparing the positional coordinates of each one of the first plurality of navigational devices 202 against the boundary coordinates associated with the traffic sample zone 302 at a first moment in time. Let it be assumed that the first moment in time corresponds to a moment in time when the first traffic light 316 displays the stop indication.

The server 230 may determine the first moment in time for which the server 230 should compare the positional coordinates of each one of the first plurality of navigational devices 202 against the boundary coordinates associated with the traffic sample zone 302 in different ways.

For example, the server 230 may receive traffic-light information from an external resource that tracks display information associated with the first traffic light 316, such as from a municipal light-traffic data center.

In another example, the server 230 may compare the speed of each one of the first plurality of navigational devices 202 to a speed threshold. The speed of each one of the first plurality of navigational devices 202 may be provided to the server 230 via the respective feedback signals or otherwise determined based on the change of positional coordinates of each one of the first plurality of navigational devices 202 in time. In this example, the server 230 may identify the first moment in time as a given moment in time when the speed of each one of the first plurality of navigational devices 202, which provide feedback signals thereto, is lower than the speed threshold. The speed threshold may be, for example, 5 km/h. As such, if at a given moment in time the speed of each one of the first plurality of navigational devices 202 is lower than the speed threshold, this means that the first traffic light 316 is displaying the stop indication and that the given moment in time is the first moment in time.

In order to determine the actual number of feedback vehicles located in the traffic sample zone 302 at the first moment in time, the server 230 may be configured to compare the positional coordinates of each one of the first plurality of navigational devices 202 against the boundary coordinates of the traffic sample zone 302 by executing various types of algorithms.

In one example, the server 230 may execute a set-inclusion algorithm. In this example, the server 230 may determine all positional coordinates that fall within the boundary coordinates of the traffic sample zone 302 and may be configured to match the positional coordinates at the first moment in time of each one of the first plurality of navigational devices 202 to any one of all positional coordinates that fall within the boundary coordinates of the traffic sample zone 302. If a match is positive for the positional coordinates at the first moment in time of a given navigational device, the server 230 may determine that the given navigational device is located in the traffic sample zone 302.

In another example, the server 230 may execute a point-in-polygon-inclusion algorithm. Generally speaking, a given point-in-polygon-inclusion algorithm determines the inclusion of a given point in a two-dimensional planar polygon. Such algorithms may include a crossing-number algorithm, for example, where a number of times a ray starting from a given point (i.e., positional coordinates at the first moment in time) crosses a polygon boundary (i.e., boundary coordinates of the traffic sample zone 302) may be computed. The execution of the crossing-number algorithm outputs a "crossing number" value, which if positive means that the point is outside the polygon and which if negative means that the point is inside the polygon.

Irrespective of a specific manner in which the server 230 may compare the positional coordinates of each one of the first plurality of navigational devices 202 against the boundary coordinates of the traffic sample zone 302, the server 230 may be configured to determine the actual number of feedback vehicles located in the traffic sample zone 302 at the first moment in time.

Let it be assumed that the server 230 determines that the actual number of navigational devices of the first plurality of navigational devices 202 that are located in the traffic sample zone 302 at the first moment in time is "3", namely the navigational devices 210, 212 and 214. This means that, at the first moment in time, "3" feedback vehicles are located in the traffic sample zone 302. It should be noted that the actual number of navigational devices that are located in the traffic sample zone 302 at the first moment in time may be different in various implementations of the present technology.

As previously mentioned, during processing of the feedback signals, the server 230 may also be configured to compute a fill rate parameter of the traffic sample zone 302 at the first moment in time. The fill rate parameter is indicative of an estimated total number of vehicles located in the traffic sample zone 302 at the first moment in time. In other words, by computing the fill rate parameter of the traffic sample zone 302 at the first moment in time, the server 230 may determine an estimated number of non-feedback vehicles located in the traffic sample zone 302 at the first moment in time.

In some embodiments of the present technology, the server 230 may be configured to compute the fill rate parameter based on (i) the positional coordinates of at least one navigational device within the boundary coordinates of the traffic sample zone 302, (ii) the boundary coordinates of the traffic sample zone 302 and (iii) the traffic characteristics of the traffic sample zone 302. In this case, the at least one navigational device within the boundary coordinates of the traffic sample zone 302 are the navigational devices 210, 212 and 214. How the server 230 computes the fill rate parameter will now be described in further detail.

In some embodiments, in order to compute the fill rate parameter, the server 230 may be configured to identify rearmost positional coordinates amongst the positional coordinates of the at least one navigational device within the boundary coordinates of the traffic sample zone 302.

Generally speaking, the rearmost positional coordinates are the positional coordinates of a rearmost navigational device amongst the at least one navigational device (i.e., the navigational devices 210, 212 and 214) within the boundary coordinates of the traffic sample zone 302. The rearmost navigational device within the boundary coordinates of the traffic sample zone 302 can be determined based on the traffic direction in the traffic sample zone 302. As previously mentioned, the traffic direction in the traffic sample zone 302 is part of the traffic characteristics of the traffic sample zone 302. The server 230 may be configured to retrieve from the database 235 the information regarding the traffic characteristics of the traffic sample zone 302. How the server 230 may identify the rearmost positional coordinates will now be described with reference to FIGS. 4 and 5.

Figure 4:
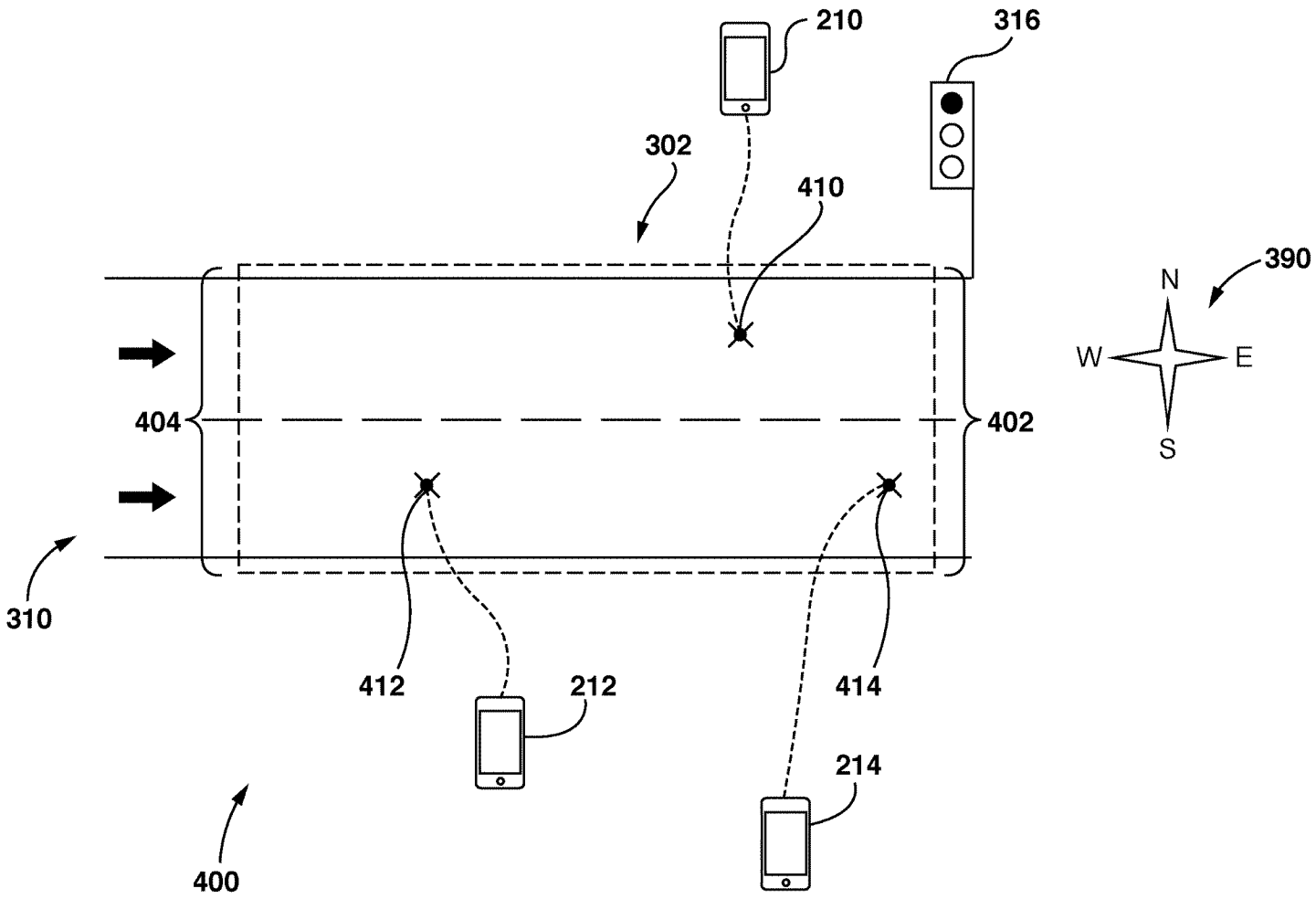
FIG. 4 depicts a zoomed region of the map illustration of FIG. 3 at a first moment in time.

In FIG. 4, there is depicted a zoomed region 400 of the map illustration 500 at the first moment in time with three markers 412, 414 and 416 which correspond to the positional coordinates of the at least one navigational device (i.e., the navigational devices 210, 212 and 214) within the boundary coordinates of the traffic sample zone 302 at the first moment in time. In other words, the marker 410 corresponds to the positional coordinates of the navigational device 210 at the first moment in time, the marker 412 corresponds to the positional coordinates of the navigational device 212 at the first moment in time and the marker 414 corresponds to the positional coordinates of the navigational device 214 at the first moment in time. The bold arrows in FIG. 4 represent the traffic direction in the traffic sample zone 302.

In some embodiments of the present technology, based on the traffic direction in the traffic sample zone 302, the server 230 may be configured to determine traffic-entering boundary coordinates 404 within the boundary coordinates of the traffic sample zone 302 and/or traffic-exiting boundary coordinates 402 within the boundary coordinates of the traffic sample zone 302.

In one embodiment, the server 230 may be configured to determine that the traffic-entering boundary coordinates 404 correspond to a subset of the boundary coordinates of the traffic sample zone 302 which defines a frontier through which a given vehicle will enter the traffic sample zone 302. In this case, since both traffic lanes are associated with the East-bound traffic direction, the frontier through which the given vehicle will enter the traffic sample zone 302 corresponds to a most-West subset of boundary coordinates of the traffic sample zone 302. Therefore, in this case, the traffic-entering boundary coordinates 404 correspond to the most-West subset of boundary coordinates of the traffic sample zone 302.

In another embodiment, the server 230 may be configured to determine that the traffic-exiting boundary coordinates 402 correspond to a subset of the boundary coordinates of the traffic sample zone 302 which defines a frontier through which a given vehicle will exit the traffic sample zone 302. In this case, since both traffic lanes are associated with the East-bound traffic direction, the frontier through which the given vehicle will exit the traffic sample zone 302 corresponds to a most-East subset of boundary coordinates of the traffic sample zone 302. Therefore, in this case, the traffic-exiting boundary coordinates 402 correspond to the most-East subset of boundary coordinates of the traffic sample zone 302.

It should be noted that the server 230 may be configured to determine at least one of the traffic-entering boundary coordinates 404 and the traffic-exiting boundary coordinates 402 prior to tracking the feedback signals of the first plurality of navigational devices 202, since such determination does not require any information provided via the feedback signals. In other words, the server 230 may be configured to (i) predetermine at least one of the traffic-entering boundary coordinates 404 and the traffic-exiting boundary coordinates 402 and (ii) store in the database 235 information regarding at least one of the traffic-entering boundary coordinates 404 and the traffic-exiting boundary coordinates 402 in association with the traffic sample zone 302.

In order to identify the rearmost positional coordinates, the server 230 may further be configured to compare each of the positional coordinates of the at least one navigational device (i.e., the navigational devices 210, 212 and 214) within the boundary coordinates of the traffic sample zone 302 at the first moment in time against at least one of the traffic-entering boundary coordinates 404 and the traffic-exiting boundary coordinates 402.

Figure 5:
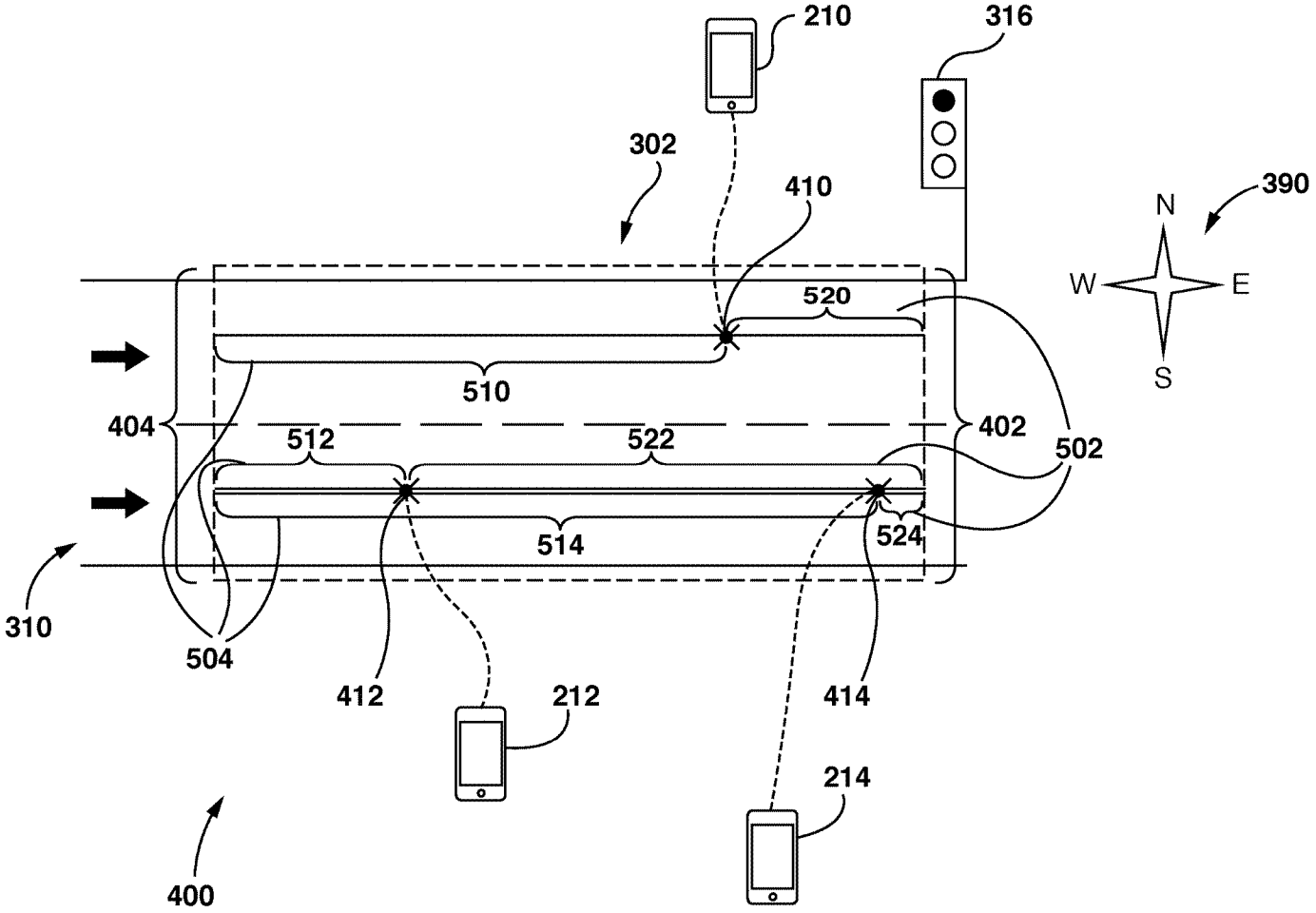
FIG. 5 depicts the zoomed region of FIG. 4 with a first set of distances and a second set of distances computed according to some embodiments of the present technology.

With reference to FIG. 5, there is depicted a first set of distances 504. The server 230 may be configured to determine the first set of distances 504 by comparing each of the positional coordinates of the at least one navigational device (i.e., the navigational devices 210, 212 and 214) within the boundary coordinates of the traffic sample zone 302 against the traffic-entering boundary coordinates 404. For example, the server 230 may be configured to determine a shortest distance between each of the positional coordinates of the at least one navigational device and any one of the traffic-entering boundary coordinates 404. As a result, the server 230 may determine a distance 510 for the navigational device 210, a distance 512 for the navigational device 212 and a distance 514 for the navigational device 214.

In this case, where the server 230 compares each of the positional coordinates of the at least one navigational device (i.e., the navigational devices 210, 212 and 214) within the boundary coordinates of the traffic sample zone 302 against the traffic-entering boundary coordinates 404, the server 230 may determine that the rearmost positional coordinates are the positional coordinates of a given navigational device that is associated with the shortest one of the first set of distances 504. The shortest one of the first set of distances 504 is associated with the closest positional coordinates amongst the positional coordinates of the at least one navigational device to the traffic-entering boundary coordinates 404. Therefore, the server 230 may determine that the rearmost positional coordinates are the positional coordinates of the navigational device 212 since the shortest distance amongst the first set of distances 504 is the distance 512. In other words, the rearmost navigational device is the navigational device 212 and the marker 412 is associated with the rearmost positional coordinates.

In FIG. 5, there is also depicted a second set of distances 502. The server 230 may be configured to determine the second set of distances 502 by comparing each of the positional coordinates of the at least one navigational device (i.e., the navigational devices 210, 212 and 214) within the boundary coordinates of the traffic sample zone 302 against the traffic-exiting boundary coordinates 402. For example, the server 230 may be configured to determine a shortest distance between each of the positional coordinates of the at least one navigational device and any one of the traffic-exiting boundary coordinates 402. As a result, the server 230 may determine a distance 520 for the navigational device 210, a distance 522 for the navigational device 212 and a distance 524 for the navigational device 214.

In this case, where the server 230 compares each of the positional coordinates of the at least one navigational device (i.e., the navigational devices 210, 212 and 214) within the boundary coordinates of the traffic sample zone 302 against the traffic-exiting boundary coordinates 402, the server 230 may determine that the rearmost positional coordinates are the positional coordinates of a given navigational device that is associated with the longest one of the second set of distances 502. The longest one of the second set of distances 502 is associated with the furthest positional coordinates amongst the positional coordinates of the at least one navigational device to the traffic-exiting boundary coordinates 402. Therefore, the server 230 may determine that the rearmost positional coordinates are the positional coordinates of the navigational device 212 since the longest distance amongst the second set of distances 502 is the distance 512. In other words, the rearmost navigational device is the navigational device 212 and the marker 412 is associated with the rearmost positional coordinates.

In order to compute the fill rate parameter of the traffic sample zone 302 at the first moment in time, the server 230 may determine an estimated number of vehicles located in a same traffic lane as the rearmost navigational device (i.e. the navigational device 212) based on (i) the rearmost positional coordinates (i.e., associated with the marker 412), (ii) the average size of vehicles (i.e., part of the traffic characteristics of the traffic sample zone 302) and (iii) the average vehicle-to-vehicle distance in the traffic sample zone 302 (i.e. part of the traffic characteristics of the traffic sample zone 302).

Figure 6:
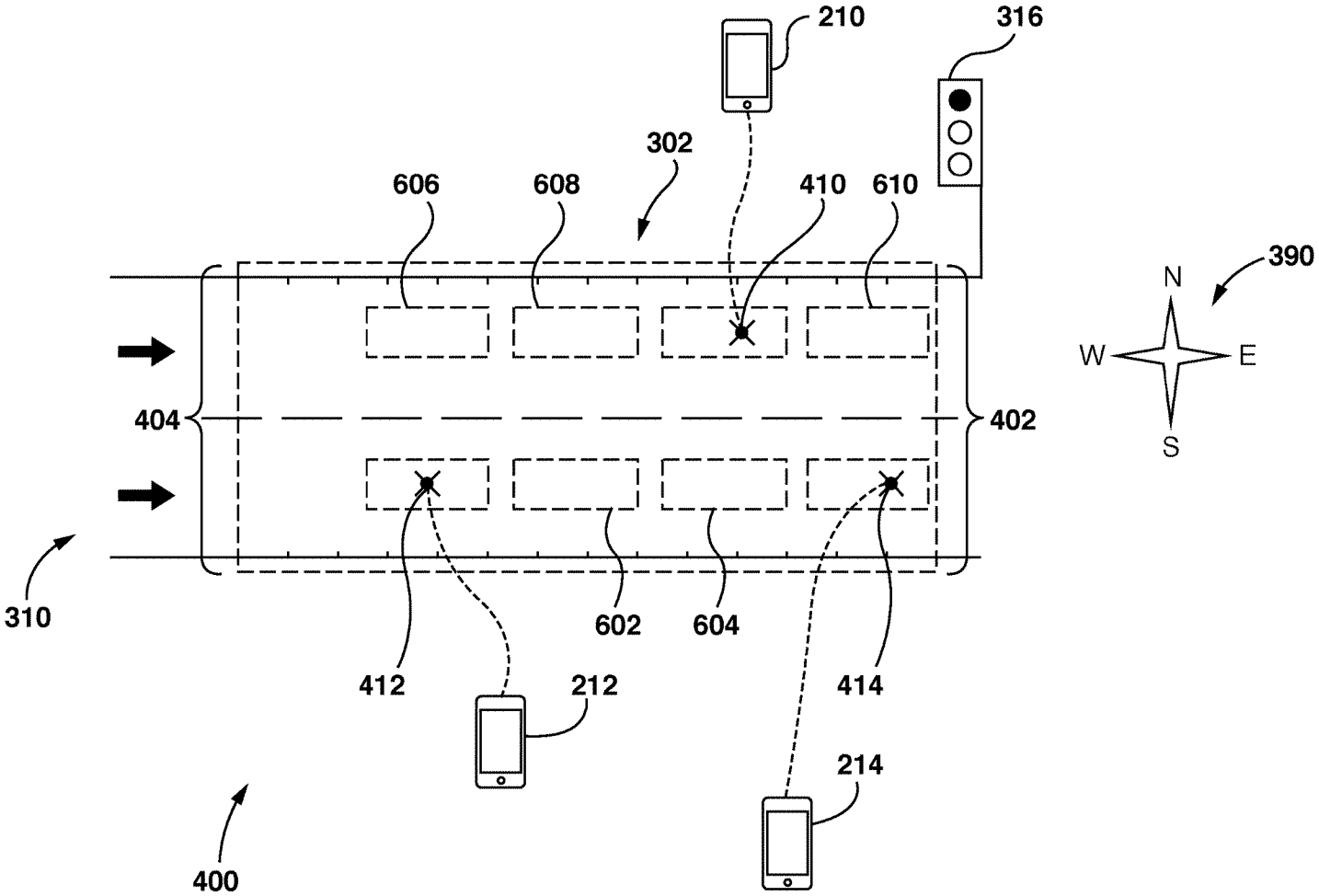
FIG. 6 depicts the zoomed region of FIG. 4 with estimated non-feedback vehicles located in a target sample zone according to some implementations of the present technology.

With reference to FIG. 6, there are depicted estimated vehicles that are located in the traffic sample zone 302. For example, let it be assumed that the distance 522 between the marker 412 at the traffic-exiting boundary coordinates 402 is 15 meters, that the average size of vehicles comprises 4.5 meters in length and that the average vehicle-to-vehicle distance in the traffic sample zone 302 at the first moment in time is 0.5 meters. As such, the server 230 may be configured to determine that the estimated number of vehicles located in a same traffic lane as the rearmost navigational device is "4" vehicles (including the feedback vehicle associated with the rearmost navigational device). In other words, the server 230 may determine, based on (i) the rearmost positional coordinates, (ii) the average size of vehicles and (iii) the average vehicle-to-vehicle distance, that the traffic lane of the rearmost navigational device comprises two feedback vehicles, respectively associated with the navigational devices 212 and 214, and two estimated non-feedback vehicles 602 and 604.

The server 230 may further determine an estimated number of vehicles located in other traffic lanes based on an assumption that all traffic lanes overlapped by the traffic sample zone 302 are filled with vehicles equally to the traffic lane of the rearmost navigational device. In other words, the server 230 may determine that the estimated number of vehicles in each traffic lane overlapped by the traffic sample zone is equal to the estimated number of vehicles in the traffic lane associated with the rearmost navigational device. As such, the server 230 determines that the other lane overlapped by the traffic sample zone 302 comprises one feedback vehicle associated with the navigational device 210 and three estimated non-feedback vehicles 606, 608 and 610.

In order to compute the fill rate parameter of the traffic sample zone 302 at the first moment in time, the server 230 may be configured to multiply the estimated number of vehicles located in the same traffic lane as the rearmost navigational device that are located in the traffic sample zone 302 by the number of traffic lanes overlapped by the traffic sample zone 302 (i.e., part of the traffic characteristics of the traffic sample zone 302). As previously mentioned, the fill rate parameter of the traffic sample zone 302 is indicative of the estimated total number of vehicles located in the traffic sample zone 302 at the first moment in time. In this case, the estimated total number of vehicles located in the traffic sample zone 302 at the first moment in time is "8" vehicles, which comprise "3" feedback vehicles respectively associated with the navigational devices 210, 212 and 214, and "5" estimated non-feedback vehicles, namely the estimated non-feedback vehicles 602, 604, 606, 608 and 610.

It should be appreciated that computing the fill rate parameter based on the rearmost positional coordinates amongst the positional coordinates of the navigational devices 210, 212 and 214 maximizes the estimated total number of vehicles located in the traffic sample zone 302 if compared to any other fill rate parameter potentially computed based on any other positional coordinates amongst the plurality of positional coordinates of the navigational devices 210, 212 and 214. In other words, computing the fill rate parameter based on the positional coordinates associated with the marker 412 maximizes the fill rate parameter if compared to the fill rate parameter potentially computed based on the positional coordinates associated with the marker 410 or with the marker 414.

For example, if the fill rate parameter was computed based on the positional coordinates associated with the marker 410, the fill rate parameter would be indicative of the estimated total number of vehicles of "5" vehicles, namely the feedback vehicles associated with the navigational devices 210, 212 and 214 and two estimated non-feedback vehicles 610 and 604.

In another example, if the fill rate parameter was computed based on the positional coordinates associated with the marker 414, the fill rate parameter would be indicative of the estimated total number of vehicles of "4" vehicles, namely the feedback vehicles associated with the navigational devices 210, 212 and 214 and one estimated non-feedback vehicle 610.

As previously mentioned, during processing of the feedback signals, the server 230 may be configured to determine the feedback ratio associated with the traffic sample zone 302. The feedback ratio is a ratio between (i) the estimated total number of vehicles located in the traffic sample zone 302 (i.e., the fill rate parameter) and (ii) the actual number of feedback vehicles located in the traffic sample zone 302. In this case, the feedback ratio for the traffic sample zone is "8/3". It should be appreciated that the feedback ratio is indicative of an estimated proportion of feedback vehicles and of non feedback-vehicles in the traffic sample zone 302. In this case, the estimated proportion of feedback vehicles and of non feedback-vehicles in the traffic sample zone 302 is "5:3".

It should be noted that the server 230 may be configured to determine the feedback ratio associated with the traffic sample zone 308 in a similar manner to how the server 230 may be configured to determine the feedback ratio associated with the traffic sample zone 302. In some embodiments, the feedback ratio may be updated by the server 230 on a periodic basis. For example, the server 230 may re-determine the feedback ratio of the traffic sample zone 302 at another moment in time that is later in time than the first moment in time by a given period of time. The re-determining of the feedback ratio of the traffic sample zone 302 at another moment in time may be executed by the server 230 in a similar manner to how the server 230 determined the feedback ratio of the traffic sample zone 302 at the first moment in time.

In some embodiments, the server 230 may be configured to re-determine the feedback ratio of the traffic sample zone 302 at another moment in time where the boundary coordinates of the traffic sample zone 302 have been dynamically updated based on the camera data.

Without wishing to be bound to any specific theory, embodiments of the present technology have been developers on the premise that the feedback ratio determined for one of the traffic sample zone 302, the exposure zone 304, the target zone 306 and the traffic sample zone 308 can be used as proxy for another one of the traffic sample zone 302, the exposure zone 304, the target zone 306 and the traffic sample zone 308 at any given moment in time after the first moment in time when the feedback ratio was calculated.

As a result, the server 230 may be configured to generate the traffic prediction for any given one of the traffic sample zone 302, the exposure zone 304, the target zone 306 and the traffic sample zone 308 at any given moment in time that is later in time than the first moment in time for which the feedback ratio was determined by the server 230.

For example, the server 230 may be configured to generate the traffic prediction for the target zone 306 at a second moment in time that is later in time than the first moment in time. It is contemplated that, although the target zone 306 is not depicted as overlapping the traffic sample zone 302, in some embodiments of the present technology, the target zone 306 may at least partially overlap the traffic sample zone 302.

To that end, the server 230 may be configured to determine an actual number of feedback vehicles located in the target zone 306 at the second moment in time.

Let it be assumed that the second plurality of navigational devices 204 is approaching the target zone 306. As previously mentioned, based on the respective boundary-trigger data packets that each one of the second plurality of navigational devices 204 received from the server 230, each one of the second plurality of navigational devices 204 is thereby triggered to generate and provide a respective feedback signal to the server 230. The server 230 may be configured to determine the actual number of feedback vehicles located in the target zone 306 based on the respective feedback signals of each one of the second plurality of navigational devices 204. Let it be assumed that the server 230 determines that "9" distinct feedback signals are provided by the second plurality of navigational devices 204 (including "3" distinct feedback signals respectively from the navigational devices 220, 222 and 224). Therefore, the server 230 may be configured to determine that at the second moment in time the actual number of feedback vehicles located in the target zone 306 is "9" feedback vehicles.

The server 230 may be configured to generate the traffic prediction for the target zone 306 based on (i) the actual number of feedback vehicles located in the target zone 306 and (ii) the feedback ratio of the traffic sample zone 302. For example, the server 230 may be configured to multiply the actual number of feedback vehicles located in the target zone 306 by the feedback ratio of the traffic sample zone 302. As such, the server 230 may generate the traffic prediction of "24" which is indicative of the total number of vehicles located in the target zone 306 at the second moment in time. The traffic prediction is also indicative that the estimated number of non-feedback vehicles (within the plurality of vehicles causing traffic in the target zone 306) is "15" (i.e., 24−9=15).

In other embodiments of the present technology, the server 230 may be configured to determine the exposure parameter for the VPOI 318. As previously mentioned, the VPOI 318 is visible to a plurality of observers (i.e., users) located in the exposure zone 304 at a given moment in time. The server 230 may be configured to compute the exposure parameter at least partially based on the feedback ratio of the traffic sample zone 302.

To that end, the server 230 may be configured to determine an actual number of feedback observers (i.e., an actual number of feedback users) located in the exposure zone 304 at the second moment in time. In some embodiments, the server 230 may be configured to determine an actual number of feedback observers (i.e., an actual number of feedback users) located in the exposure zone 304 at the second moment in time where the boundary coordinates of the exposure zone 304 have been dynamically updated based on the camera data.

Let it be assumed that the second plurality of navigational devices 204 is approaching the exposure zone 304. As previously mentioned, based on the respective boundary-trigger data packets that each one of the second plurality of navigational devices 204 received from the server 230, each one of the second plurality of navigational devices 204 is thereby triggered to generate and provide a respective feedback signal to the server 230. The server 230 may be configured to determine the actual number of feedback observers located in the exposure zone 304 based on the respective feedback signals of each one of the second plurality of navigational devices 204. Let it be assumed that the server 230 determines that "6" distinct feedback signals are provided by the second plurality of navigational devices 204 (including "3" distinct feedback signals respectively from the navigational devices 220, 222 and 224). Therefore, the server 230 may be configured to determine that at the second moment in time the actual number of feedback observers located in the target zone 306 is "6" feedback observers.

The server 230 may be configured to determine the exposure parameter for the VPOI 318 based on (i) the actual number of feedback observers located in the exposure zone 304 and (ii) the feedback ratio of the traffic sample zone 302. For example, the server 230 may be configured to multiply the actual number of feedback observers located in the exposure zone 304 by the feedback ratio of the traffic sample zone 302. As such, the server 230 may determine that the exposure parameter is "16" which is indicative of an estimated number of observers that possibly viewed the VPOI 318 at the second moment in time. The exposure parameter is also indicative that the estimated number of non-feedback observers (within the plurality of observers located in in the exposure zone 304) is "10" (i.e., 16−6=10).

Figure 7:
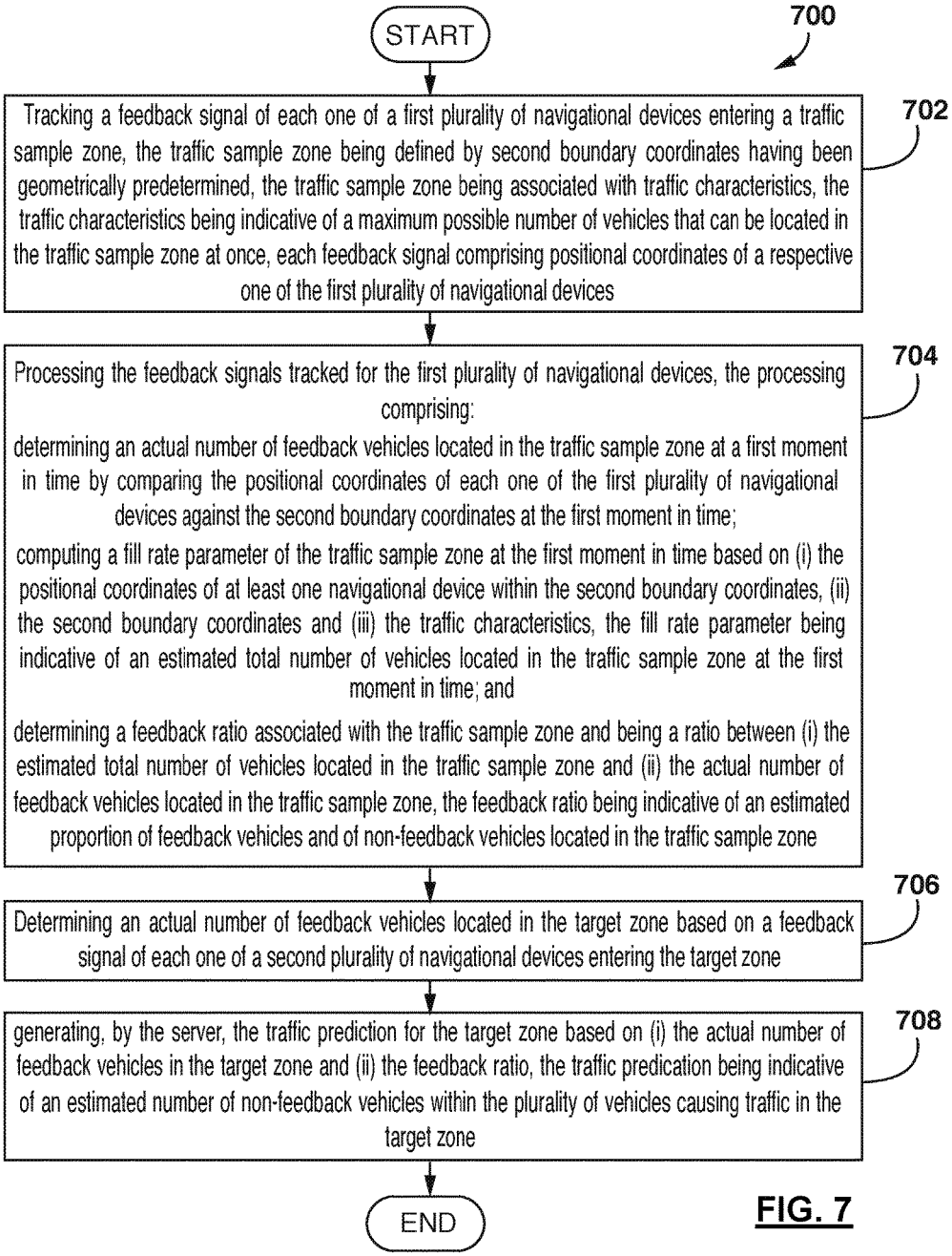
FIG. 7 is a block diagram depicting a flow chart of a method of generating a traffic prediction according to some implementations of the present technology.

In some embodiments of the present technology, the server 230 may be configured to execute a method 700 of generating the traffic perdition, depicted in FIG. 7. The method 700 will now be described.

STEP 702: Tracking a Feedback Signal of Each One of a First Plurality of Navigational Devices Entering a Traffic Sample Zone The method 700 of generating the traffic prediction for the target zone 306 depicted in FIG. 3 begins at step 702. During the step 702, the server 230 may be configured to track the feedback signal of each one of the first plurality of navigational devices 202 entering the traffic sample zone 302. Each feedback signal comprises positional coordinates of a respective one of the first plurality of navigational devices 202.

The traffic sample zone 302 is defined by boundary coordinates having been geometrically predetermined. In some embodiments of the present technology, the boundary coordinates of the target zone 306 may at least partially overlap the boundary coordinates of the traffic sample zone 302.

In other embodiments of the present technology, the server 230 may provide to the first and second plurality of navigational devices 202 and 204 information associated with the boundary coordinates of the traffic sample zone 302 and with the boundary coordinates of the target zone 306. For example, the server 230 may be configured to generate and transmit the plurality of boundary-trigger data packets 238 where each one of the plurality of boundary-trigger data packets 238 comprises information associated with the boundary coordinates of the traffic sample zone 302 and with the boundary coordinates of the target zone 306 and is transmitted to a respective each one of the first and second pluralities of navigational devices 202 and 204.

Additionally, each boundary-trigger data packet comprises computer-readable instructions that, when executed by a respective navigational device, may trigger the respective navigational device to generate and provide a respective feedback signal to the server 230 upon the respective navigational device approaching any of the respective boundary coordinates of the traffic sample zone 302 and the target zone 306 (i.e., the feedback signal trigger).

The traffic sample zone 302 may be associated with traffic characteristics which are indicative of the maximum possible number of vehicles that can be located in the traffic sample zone at once.

In some embodiments, the traffic characteristics comprise the first type of traffic characteristic and the second type of traffic characteristic. The first type of traffic characteristic may be the vehicle-specific traffic characteristic associated with typical vehicles travelling through the traffic sample zone 302. The second type of traffic characteristic may be the zone-specific traffic characteristic.

Additionally, the vehicle-specific traffic characteristic comprises the average size of vehicles. In some implementations, the average size of vehicles is 4.5 meters in length and 1.8 meters in width.

Also, the zone-specific traffic characteristic comprises the area overlapped by the traffic sample zone 302, the number of traffic lanes overlapped by the traffic sample zone 302, the traffic direction in the traffic sample zone 302, and the average vehicle-to-vehicle distance in the traffic sample zone 302.

In some embodiments of the present technology, the traffic characteristics associated with the traffic sample zone 302 may be predetermined, that is, determined prior to the processing of feedback signals by the server 230. The traffic characteristics may also be stored in the database 235 in associated with the boundary coordinates of the traffic sample zone 302.

STEP 704: Processing the Feedback Signals Tracked for the First Plurality of Navigational Devices The method continues to step 704 with the server 230 being configured to process the feedback signals tracked for the first plurality of navigational devices 202.

In order to process the feedback signals, the server 230 may be configured to determine the actual number of feedback vehicles located in the traffic sample zone 302 at the first moment in time by comparing the positional coordinates of each one of the first plurality of navigational devices 202 against the boundary coordinates of the traffic sample zone 302 at the first moment in time.

In order to process the feedback signals, the server 230 may also be configured to compute the fill rate parameter of the traffic sample zone at the first moment in time based on (i) the positional coordinates of at least one navigational device within the boundary coordinates of the traffic sample zone 302, (ii) the boundary coordinates of the traffic sample zone 302 and (iii) the traffic characteristics of the traffic sample zone 302. The fill rate parameter is indicative of the estimated total number of vehicles located in the traffic sample zone 302 at the first moment in time.

In some embodiments of the present technology, in order to compute the fill rate parameter, the server 230 may be configured to identify the rearmost positional coordinates amongst the positional coordinates of the at least one navigational device within the boundary coordinates of the traffic sample zone 302. The rearmost positional coordinates are the positional coordinates of the rearmost navigational device amongst the at least one navigational device within the boundary coordinates of the traffic sample zone 302 according to the traffic direction in the traffic sample zone 302.

In order to identify the rearmost positional coordinates of the at least one navigational device within the boundary coordinates of the traffic sample zone 302, the server 230 may determine at least one of (i) the traffic-entering boundary coordinates 404 depicted in FIG. 4 and (ii) the traffic-exiting boundary coordinates 402 based on the traffic direction in the traffic sample zone 302. The server 230 may then compare each of the positional coordinates of the at least one navigational device (i.e., the positional coordinates of the navigational devices 210, 212 and 214) which are in the boundary coordinates of the traffic sample zone 302 against the at least one of (i) the traffic-entering boundary coordinates 404 and (ii) the traffic-exiting boundary coordinates 402.

For example, in order to compare each of the positional coordinates of the at least one navigational device (i.e., the positional coordinates of the navigational devices 210, 212 and 214) against the traffic-entering boundary coordinates 404, the server 230 may determine the first set of distances 504 (see FIG. 5).

In another example, in order to compare each of the positional coordinates of the at least one navigational device (i.e., the positional coordinates of the navigational devices 210, 212 and 214) against the traffic-exiting boundary coordinates 402, the server 230 may determine the second set of distances 502 (see FIG. 5).

In order to identify the rearmost positional coordinates amongst the positional coordinates of the navigational devices 210, 212 and 214, the server 230 may also be configured to select a given one of the positional coordinates of the navigational devices 210, 212 and 214 as the rearmost positional coordinates such that the given one of the positional coordinates is at least one of (i) closest positional coordinates amongst the positional coordinates to the traffic-entering boundary coordinates 404 and (ii) farthest positional coordinates amongst the positional coordinates from the traffic-exiting boundary coordinates 402. This can be achieved by determined at least one of (i) the shortest distance amongst the first set of distances 504 and (ii) the longest distance amongst the second set of distances 502. As such, the positional coordinates associated with either one of the shortest distance amongst the first set of distances 504 and the longest distance amongst the second set of distances 502 are the rearmost positional coordinates of the rearmost navigational device within the boundary coordinates of the traffic sample zone 302.

In order to compute the fill rate parameter, the server 230 may be configured to determine the estimated number of vehicles located in a same traffic lane as the rearmost navigational device based on (i) the rearmost positional coordinates, (ii) the average size of vehicles in the traffic sample zone 302, and (iii) the average vehicle-to-vehicle distance in the traffic sample zone 302. The server 230 may then multiply the estimated number of vehicles located in the same traffic lane as the rearmost navigational device by the number of traffic lanes overlapped by the traffic sample zone 302.

With reference to FIG. 6, there are depicted the estimated vehicles that are located in the traffic sample zone 302. For example, let it be assumed that the distance 522 between the marker 412 at the traffic-exiting boundary coordinates 402 is 15 meters, that the average size of vehicles comprises 4.5 meters in length and that the average vehicle-to-vehicle distance in the traffic sample zone 302 at the first moment in time is 0.5 meters.

As such, the server 230 may be configured to determine that the estimated number of vehicles located in a same traffic lane as the rearmost navigational device is "4" vehicles (including the feedback vehicle associated with the rearmost navigational device). In other words, the server 230 may determine, based on (i) the rearmost positional coordinates, (ii) the average size of vehicles and (iii) the average vehicle-to-vehicle distance, that the traffic lane of the rearmost navigational device comprises two feedback vehicles, respectively associated with the navigational devices 412 and 414, and two estimated non-feedback vehicles 602 and 604.

The server 230 may further determine the estimated number of vehicles located in other traffic lanes based on the hypothesis that all traffic lanes overlapped by the traffic sample zone 302 are filled with vehicles equally to the traffic lane of the rearmost navigational device. In other words, the server 230 may determine that the estimated number of vehicles in each traffic lane overlapped by the traffic sample zone is equal to the estimated number of vehicles in the traffic lane associated with the rearmost navigational device. As such, the server 230 determines that the other lane overlapped by the traffic sample zone 302 comprises one feedback vehicle associated with the navigational device 210 and three estimated non-feedback vehicles 606, 608 and 610.

In this case, the estimated total number of vehicles located in the traffic sample zone 302 at the first moment in time is "8" vehicles, which comprise "3" feedback vehicles respectively associated with the navigational devices 210, 212 and 214, and "5" estimated non-feedback vehicles, namely the estimated non-feedback vehicles 602, 604, 606, 608 and 610.

In some embodiments of the present technology, it is contemplated that computing the fill rate parameter based on the rearmost positional coordinates amongst the positional coordinates of the at least one navigational device maximises the estimated total number of vehicles located in the traffic sample zone 302 if compared to any other fill rate parameter computed based on any other positional coordinates amongst the positional coordinates of the at least one navigational device.

In some embodiments of the present technology, it is contemplated that at least one navigational device may have a camera for visually detecting vehicle-to-vehicle distance (e.g. using computer vision and visual detection solutions) in the traffic sample zone 302. In another example, the embedded camera for visually detecting vehicle-to-vehicle distance may be at least one vehicle may be equipped with the camera in the traffic sample zone 302.

For example, if the fill rate parameter was computed based on the positional coordinates associated with the marker 410, the fill rate parameter would be indicative of the estimated total number of vehicles of "5" vehicles, namely the feedback vehicles associated with the navigational devices 210, 212 and 214 and two estimated non-feedback vehicles 610 and 604.

In another example, if the fill rate parameter was computed based on the positional coordinates associated with the marker 414, the fill rate parameter would be indicative of the estimated total number of vehicles of "4" vehicles, namely the feedback vehicles associated with the navigational devices 210, 212 and 214 and one estimated non-feedback vehicle 610.

During processing of the feedback signals, the server 230 may be configured to determine the feedback ratio associated with the traffic sample zone 302. The feedback ratio is a ratio between (i) the estimated total number of vehicles located in the traffic sample zone 302 and (ii) the actual number of feedback vehicles located in the traffic sample zone 302. The feedback ratio is indicative of the estimated proportion of feedback vehicles and of non-feedback vehicles located in the traffic sample zone 302.

In some embodiments, the feedback ratio may be updated by the server 230 on a periodical basis. For example, the server 230 may re-determine the feedback ratio of the traffic sample zone 302 at another moment in time that is later in time than the first moment in time by a given period of time. The re-determining of the feedback ratio of the traffic sample zone 302 at another moment in time may be executed by the server 230 in a similar manner to how the server 230 determined the feedback ratio of the traffic sample zone 302 at the first moment in time.

STEP 706: Determining an Actual Number of Feedback Vehicles Located in the Target Zone The method 700 continues to step 706 with the server 230 being configured to determine the actual number of feedback vehicles located in the target zone 306 based on the feedback signal of each one of the second plurality of navigational devices 204 entering the target zone 306. The server 230 may be configured to determine the actual number of feedback vehicles located in the target zone 306 similarly to how the server 230 is configured to determine the actual number of feedback vehicles located in the traffic sample zone 302 at the first moment in time during execution of the step 704.

In some embodiments of the present technology, the server 230 may determine the actual number of feedback vehicles located in the target zone 306 at the second moment in time being later in time than the first moment in time.

It is contemplated that, in some embodiments of the present technology, the boundary coordinates of the target zone 306 at the second moment in time may be dynamically updated based on the camera data. This means that the boundary coordinates of the target zone 306 at the first moment in time may be different from the boundary coordinates of the target sample zone 306 at the second moment in time.

STEP 708: Generating the Traffic Prediction for the Target Zone

The method 700 ends at step 708 with the server 230 generating the traffic prediction for the target zone 306 based on (i) the actual number of feedback vehicles in the target zone 306 and (ii) the feedback ratio.

We should mention that 708 is done at a second moment in time, after the first moment in time. I.e. we need to generate the feedback ration first and then we can do step 708.

In some embodiments of the present technology, the server 230 may be configured to generate the traffic prediction for the target zone 306 at the second moment in time being later in time than the first moment in time. This means that the step 708 may be executable by the server 230 at the second moment in time being later in time than the first moment in time at which the step 704 may be executable by the server 230. The traffic predication is indicative of the estimated number of non-feedback vehicles within the plurality of vehicles causing traffic in the target zone 306.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A method of generating a traffic prediction for a target zone, the target zone being defined by first boundary coordinates having been geometrically predetermined, traffic in the target zone being caused by a plurality of vehicles located in the target zone at a given moment in time, the plurality of vehicles comprising feedback vehicles and non-feedback vehicles, each of the feedback vehicles being associated with a respective navigational device, the navigational devices being communicatively coupled to a server by a communication network and configured to provide respective feedback signals to the server, the method being executable on the server and comprising:

tracking, by the server, a feedback signal of each one of a first plurality of navigational devices entering a traffic sample zone, the traffic sample zone being defined by second boundary coordinates having been geometrically predetermined, the traffic sample zone being associated with traffic characteristics, the traffic characteristics being indicative of a maximum possible number of vehicles that can be located in the traffic sample zone at once, each feedback signal comprising positional coordinates of a respective one of the first plurality of navigational devices;

processing, by the server, the feedback signals tracked for the first plurality of navigational devices, the processing comprising:

determining, by the server, an actual number of feedback vehicles located in the traffic sample zone at a first moment in time by comparing the positional coordinates of each one of the first plurality of navigational devices against the second boundary coordinates at the first moment in time;

computing, by the server, a fill rate parameter of the traffic sample zone at the first moment in time based on (i) the positional coordinates of at least one navigational device within the second boundary coordinates, (ii) the second boundary coordinates and (iii) the traffic characteristics, the fill rate parameter being indicative of an estimated total number of vehicles located in the traffic sample zone at the first moment in time; and determining, by the server, a feedback ratio associated with the traffic sample zone and being a ratio between (i) the estimated total number of vehicles located in the traffic sample zone and (ii) the actual number of feedback vehicles located in the traffic sample zone, the feedback ratio being indicative of an estimated proportion of feedback vehicles and of non-feedback vehicles located in the traffic sample zone;

determining, by the server, an actual number of feedback vehicles located in the target zone based on a feedback signal of each one of a second plurality of navigational devices entering the target zone; and generating, by the server, the traffic prediction for the target zone based on (i) the actual number of feedback vehicles in the target zone and (ii) the feedback ratio, the traffic predication being indicative of an estimated number of non-feedback vehicles within the plurality of vehicles causing traffic in the target zone.

2. The method of claim 1, wherein the method further comprises providing, by the server to the navigational devices information associated with the first and second boundary coordinates.

3. The method of claim 1, wherein the traffic characteristics comprise a first type of traffic characteristic and a second type of traffic characteristic.

4. The method of claim 3, wherein the first type of traffic characteristic is a vehicle-specific traffic characteristic and the second type of traffic characteristic is a zone-specific traffic characteristic.

5. The method of claim 4, wherein the vehicle-specific traffic characteristic comprises an average size of vehicles.

6. The method of claim 5, wherein the zone-specific traffic characteristic comprises:

an area overlapped by the traffic sample zone;

a number of traffic lanes overlapped by the traffic sample zone;

a traffic direction in the traffic sample zone; and an average vehicle-to-vehicle distance in the traffic sample zone.

7. The method of claim 6, wherein the computing the fill rate parameter comprises identifying, by the server, rearmost positional coordinates amongst the positional coordinates of the at least one navigational device within the second boundary coordinates, the rearmost positional coordinates being the positional coordinates of a rearmost navigational device amongst the at least one navigational device within the second boundary coordinates according to the traffic direction in the traffic sample zone.

8. The method of claim 7, wherein the identifying rearmost positional coordinates amongst the positional coordinates of the at least one navigational device within the second boundary coordinates comprises:

determining, by the server, at least one of (i) traffic-entering boundary coordinates within the second boundary coordinates and (ii) traffic-exiting boundary coordinates within the second boundary coordinates based on the traffic direction in the traffic sample zone;

comparing, by the server, each of the positional coordinates of the at least one navigational device within the second boundary coordinates against the at least one of (i) the traffic-entering boundary coordinates and (ii) the traffic-exiting boundary coordinates; and selecting, by the server, a given one of the positional coordinates of the at least one navigational device as the rearmost positional coordinates such that the given one of the positional coordinates is at least one of (i) closest positional coordinates amongst the positional coordinates of the at least one navigational device to the traffic-entering boundary coordinates and (ii) farthest positional coordinates amongst the positional coordinates of the at least one navigational device from the traffic-exiting boundary coordinates.

9. The method of claim 7, wherein the computing the fill rate parameter based on the rearmost positional coordinates amongst the positional coordinates of the at least one navigational device within the second boundary coordinates comprises computing, by the server, the fill rate parameter such that to maximize the estimated total number of vehicles located in the traffic sample zone in comparison with any other fill rate parameter if computed based on any other positional coordinates amongst the positional coordinates of the at least one navigational device within the second boundary coordinates.

10. The method of claim 7, wherein the computing the fill rate parameter comprises:

determining, by the server, an estimated number of vehicles located in a same traffic lane as the rearmost navigational device and located in the traffic sample zone based on (i) the rearmost positional coordinates, (ii) the average size of vehicles, and (iii) the average vehicle-to-vehicle distance in the traffic sample zone; and multiplying, by the server, the estimated number of vehicles located in the same traffic lane as the rearmost navigational device and located in the traffic sample zone by the number of traffic lanes overlapped by the traffic sample zone.

11. The method of claim 1, wherein the determining the actual number of feedback vehicles located in the target zone and the generating the traffic prediction for the target zone are executable at a second moment in time being later in time than the first moment in time.

12. The method of claim 1, wherein the feedback ratio is updated by the server on a periodic basis.

13. The method of claim 1, wherein the target zone at least partially overlaps the traffic sample zone.

14. The method of claim 1, wherein the first plurality of navigational devices comprises at least one navigational device amongst the second plurality of navigational devices.

15. A method of determining an exposure parameter for a visual point of interest (VPOI), the VPOI being visible to a plurality of observers located in an exposure zone at a given moment in time, the exposure zone being defined by first boundary coordinates having been geometrically predetermined based on at least a location of the VPOI, the plurality of observers comprising feedback observers and non-feedback observers, each of the feedback observers being associated with a respective navigational device, the navigational devices being communicatively coupled to a server by a communication network and configured to provide respective feedback signals to the server, the method being executable on the server and comprising:

tracking, by the server, a feedback signal of each one of a first plurality of navigational devices entering a traffic sample zone, the traffic sample zone being defined by second boundary coordinates having been geometrically predetermined, the traffic sample zone being associated with traffic characteristics, the traffic characteristics being indicative of a maximum possible number of observers that can be located in the traffic sample zone at once, each feedback signal comprising positional coordinates of a respective one of the first plurality of navigational devices;

processing, by the server, the feedback signals tracked for the first plurality of navigational devices, the processing comprising:

determining, by the server, an actual number of feedback observers located in the traffic sample zone at a first moment in time by comparing the positional coordinates of each one of the first plurality of navigational devices against the second boundary coordinates at the first moment in time;

computing, by the server, a fill rate parameter of the traffic sample zone at the first moment in time based on (i) the positional coordinates of at least one navigational device within the second boundary coordinates, (ii) the second boundary coordinates and (iii) the traffic characteristics, the fill rate parameter being indicative of an estimated total number of observers located in the traffic sample zone at the first moment in time; and determining, by the server, a feedback ratio associated with the traffic sample zone and being a ratio between (i) the estimated total number of observers located in the traffic sample zone and (ii) the actual number of feedback observers located in the traffic sample zone, the feedback ratio being indicative of an estimated proportion of feedback observers and of non-feedback observers located in the traffic sample zone;

determining, by the server, an actual number of feedback observers located in the exposure zone based on a feedback signal of each one of a second plurality of navigational devices entering the exposure zone; and determining, by the server, the exposure parameter for the VPOI based on (i) the actual number of feedback observers in the exposure zone and (ii) the feedback ratio, the exposure parameter being indicative of an estimated number of observers that possibly viewed the VPOI.

16. The method of claim 15, wherein the traffic characteristics comprise a first type of traffic characteristic being a vehicle-specific traffic characteristic and a second type of traffic characteristic being a zone-specific traffic characteristic, the vehicle-specific traffic characteristic comprises an average size of vehicles, the zone-specific traffic characteristic comprises:

an area overlapped by the traffic sample zone;

a number of traffic lanes overlapped by the traffic sample zone;

a traffic direction in the traffic sample zone; and an average vehicle-to-vehicle distance in the traffic sample zone, and wherein the computing the fill rate parameter comprises identifying, by the server, rearmost positional coordinates amongst the positional coordinates of the at least one navigational device within the second boundary coordinates, the rearmost positional coordinates being the positional coordinates of a rearmost navigational device amongst the at least one navigational device within the second boundary coordinates according to the traffic direction in the traffic sample zone.

17. The method of claim 15, wherein the first boundary coordinates are dynamically updated based on camera data for the second moment in time.

18. A server for generating a traffic prediction for a target zone, the target zone being defined by first boundary coordinates having been geometrically predetermined, traffic in the target zone being caused by a plurality of vehicles located in the target zone at a given moment in time, the plurality of vehicles comprising feedback vehicles and non-feedback vehicles, each of the feedback vehicles being associated with a respective navigational device, the navigational devices being communicatively coupled to the server by a communication network and configured to provide respective feedback signals to the server, the server being configured to:

track a feedback signal of each one of a first plurality of navigational devices entering a traffic sample zone, the traffic sample zone being defined by second boundary coordinates having been geometrically predetermined, the traffic sample zone being associated with traffic characteristics, the traffic characteristics being indicative of a maximum possible number of vehicles that can be located in the traffic sample zone at once, each feedback signal comprising positional coordinates of a respective one of the first plurality of navigational devices;

process the feedback signals tracked for the first plurality of navigational devices, the server configured to process being further configured to:

determine an actual number of feedback vehicles located in the traffic sample zone at a first moment in time by comparing the positional coordinates of each one of the first plurality of navigational devices against the second boundary coordinates at the first moment in time;

compute a fill rate parameter of the traffic sample zone at the first moment in time based on (i) the positional coordinates of at least one navigational device within the second boundary coordinates, (ii) the second boundary coordinates and (iii) the traffic characteristics, the fill rate parameter being indicative of an estimated total number of vehicles located in the traffic sample zone at the first moment in time; and determine a feedback ratio associated with the traffic sample zone and being a ratio between (i) the estimated total number of vehicles located in the traffic sample zone and (ii) the actual number of feedback vehicles located in the traffic sample zone, the feedback ratio being indicative of an estimated proportion of feedback vehicles and of non-feedback vehicles located in the traffic sample zone;

determine an actual number of feedback vehicles located in the target zone based on a feedback signal of each one of a second plurality of navigational devices entering the target zone; and generate the traffic prediction for the target zone based on (i) the actual number of feedback vehicles in the target zone and (ii) the feedback ratio, the traffic predication being indicative of an estimated number of non-feedback vehicles within the plurality of vehicles causing traffic in the target zone.

19. The server of claim 18, wherein the traffic characteristics comprise a first type of traffic characteristic being a vehicle-specific traffic characteristic and a second type of traffic characteristic being a zone-specific traffic characteristic, the vehicle-specific traffic characteristic comprises an average size of vehicles, the zone-specific traffic characteristic comprises:

an area overlapped by the traffic sample zone;

a number of traffic lanes overlapped by the traffic sample zone;

a traffic direction in the traffic sample zone; and an average vehicle-to-vehicle distance in the traffic sample zone, and wherein the server configured to compute the fill rate parameter is further configured to identify rearmost positional coordinates amongst the positional coordinates of the at least one navigational device within the second boundary coordinates, the rearmost positional coordinates being the positional coordinates of a rearmost navigational device amongst the at least one navigational device within the second boundary coordinates according to the traffic direction in the traffic sample zone.

20. The server of claim 19, wherein the server configured to compute the fill rate parameter is further configured to:

determine an estimated number of vehicles located in a same traffic lane as the rearmost navigational device and located in the traffic sample zone based on (i) the rearmost positional coordinates, (ii) the average size of vehicles, and (iii) the average vehicle-to-vehicle distance in the traffic sample zone; and multiply the estimated number of vehicles located in the same traffic lane as the rearmost navigational device and located in the traffic sample zone by the number of traffic lanes overlapped by the traffic sample zone.

* * * * *